US010267163B2

(12) United States Patent
Spangler et al.

(10) Patent No.: US 10,267,163 B2
(45) Date of Patent: Apr. 23, 2019

(54) AIRFOIL TURN CAPS IN GAS TURBINE ENGINES

(71) Applicant: United Technologies Corporation, Farmington, CT (US)

(72) Inventors: Brandon W. Spangler, Vernon, CT (US); Dominic J. Mongillo, West Hartford, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 169 days.

(21) Appl. No.: 15/584,106

(22) Filed: May 2, 2017

(65) Prior Publication Data

US 2018/0320531 A1 Nov. 8, 2018

(51) Int. Cl.
*F01D 5/00* (2006.01)
*F01D 5/18* (2006.01)
(Continued)

(52) U.S. Cl.
CPC ..... *F01D 5/187* (2013.01); *F01D 5/147* (2013.01); *F01D 9/041* (2013.01); *F05D 2210/40* (2013.01); *F05D 2220/32* (2013.01); *F05D 2230/211* (2013.01); *F05D 2240/125* (2013.01); *F05D 2240/305* (2013.01);
(Continued)

(58) Field of Classification Search
CPC ..... F01D 5/147; F01D 5/187; F01D 9/041; F05D 2260/22141; F05D 2240/125; F05D 2240/305; F05D 2240/306; F05D 2220/32
See application file for complete search history.

(56) References Cited

U.S. PATENT DOCUMENTS 4,257,737 A * 3/1981 Andress ..... F01D 5/187 415/115
5,393,198 A * 2/1995 Noda ..... F01D 5/187 415/115
(Continued)

FOREIGN PATENT DOCUMENTS

EP 0735240 A1 10/1996
EP 3106621 A2 12/2016
(Continued)

OTHER PUBLICATIONS

European Search Report, European Application No. 18170456.0, dated Aug. 6, 2018, European Patent Office; EP Search Report 9 pages.

*Primary Examiner* — Hieu T Vo
*Assistant Examiner* — Sherman Manley
(74) *Attorney, Agent, or Firm* — Cantor Colburn LLP

(57) ABSTRACT

Turn caps for airfoils of gas turbine engines having a first pressure-side turn passage extending from a respective inlet to a respective outlet within the turn cap, a first suction-side turn passage extending from a respective inlet to a respective outlet within the turn cap, and a merging chamber fluidly connected to the outlets of the first pressure-side turn passage and the first suction-side turn passage, wherein each of the first suction-side turn passage and the first pressure-side turn passage turn a direction of fluid flow from a first direction to a second direction such that a fluid flow exiting the first suction-side turn passage and the first pressure-side turn passage are aligned when entering the merging chamber.

20 Claims, 12 Drawing Sheets

(51) Int. Cl.
*F01D 9/04* (2006.01)
*F01D 5/14* (2006.01)

(52) U.S. Cl.
CPC .. *F05D 2240/306* (2013.01); *F05D 2250/185* (2013.01); *F05D 2260/22141* (2013.01)

(56) References Cited

U.S. PATENT DOCUMENTS 5,511,309 A 4/1996 Beabout
5,525,038 A * 6/1996 Sharma ..... F01D 5/141 416/223 A
6,126,394 A * 10/2000 Matsuda ..... F01D 5/142 415/192
6,299,412 B1 * 10/2001 Wood ..... F01D 5/141 416/223 A
7,785,072 B1 8/2010 Liang et al.
8,192,153 B2 * 6/2012 Harvey ..... F01D 5/141 415/191
8,202,054 B2 * 6/2012 Liang ..... F01D 5/186 416/97 R
8,292,582 B1 10/2012 Liang
8,602,741 B2 * 12/2013 Ahmad ..... F01D 5/143 416/233
8,821,111 B2 9/2014 Gear et al.
8,870,524 B1 10/2014 Liang
9,550,267 B2 * 1/2017 Beckman ..... B24B 31/116
9,631,499 B2 * 4/2017 Liang ..... F01D 5/187
2005/0276698 A1 12/2005 Kvasnak et al.
2009/0068023 A1 3/2009 Liang
2009/0148287 A1 6/2009 Suciu et al.
2009/0324423 A1 12/2009 Liang
2014/0050893 A1 2/2014 Paige et al.
2016/0312632 A1 10/2016 Hagan et al.
2016/0376897 A1 12/2016 Spangler
2018/0195397 A1 7/2018 Spangler
2018/0223676 A1 8/2018 Spangler et al.
2018/0306036 A1 10/2018 Spangler et al.

FOREIGN PATENT DOCUMENTS

EP 3109405 A1 12/2016
EP 3128130 A1 2/2017
EP 3184738 A1 6/2017
EP 3184745 A1 6/2017
EP 3284908 A2 2/2018

* cited by examiner

AIRFOIL TURN CAPS IN GAS TURBINE ENGINES

BACKGROUND

The subject matter disclosed herein generally relates to cooling flow in airfoils of gas turbine engines and, more particularly, to airfoil turn caps for cooling flow passages within airfoils in gas turbine engines.

In gas turbine engines, cooling air may be configured to flow through an internal cavity of an airfoil to prevent overheating. Gas temperature profiles are usually hotter at the outer diameter than at the inner diameter of the airfoils. In order to utilize cooling flow efficiently and minimize heat pickup and pressure loss, the cross-sectional area of the internal cooling flow may be configured to vary so that Mach numbers remain low where heat transfer is not needed (typically the inner diameter) and high Mach numbers where heat transfer is needed (typically the outer diameter). To do this in a casting, the walls of the airfoils tend to be thick in some areas and thin in other areas, which may add weight to the engine in which the airfoils are employed. Previously, baffles have been used to occupy some of the space within the internal cavity of the airfoils, referred to herein as "space-eater" baffles. The baffles extend from one end of the cavity all the way through the other end of the cavity within the airfoil. This configuration may result in relatively high Mach numbers to provide cooling throughout the cavity. Further, such configuration may provide high heat transfer, and pressure loss throughout the cavity.

In order to achieve metal temperatures required to meet full life with the cooling flow allocated, the "space-eater" baffles are required to be used inside an airfoil serpentine cooling passage. The serpentine turns are typically located outside gas path endwalls to allow the "space-eater" baffles to extend all the way to the gas path endwall (e.g., extend out of the cavity of the airfoil). However, because the airfoil may be bowed, the turn walls must also follow the arc of the bow to provide clearance for the "space-eater" baffles to be inserted. During manufacture, because the wax die end blocks do not have the same pull direction as the bow of the airfoil, the turn walls cannot be cast without creating a die-lock situation and trapping the wax die.

Thus it is desirable to provide means of controlling the heat transfer and pressure loss in airfoils of gas turbine engines, particularly at the endwall turn for serpentine gas paths.

SUMMARY

According to some embodiments, airfoils for gas turbine engines are provided. The airfoils include a hollow body defining a first up-pass cavity and a first down-pass cavity, the hollow body having an inner diameter end and an outer diameter end, the first up-pass cavity having a respective first pressure side airfoil passage and a respective first suction side airfoil passage, a first airfoil platform at one of the inner diameter end and the outer diameter end of the hollow body, the first airfoil platform having a gas path surface and a non-gas path surface, wherein the hollow body extends from the gas path surface, a first up-pass cavity opening formed in the non-gas path surface of the first airfoil platform fluidly connected to the first up-pass cavity, a first down-pass cavity opening formed in the non-gas path surface of the first airfoil platform fluidly connected to the first down-pass cavity, and a first turn cap fixedly attached to the first airfoil platform on the non-gas path surface covering the first up-pass cavity opening and the first down-pass cavity opening of the first airfoil platform. The first turn cap includes a merging chamber fluidly connected to the first down-pass cavity when the turn cap is attached to the first airfoil platform, a first pressure-side turn passage fluidly connecting the first pressure side airfoil passage to the merging chamber when the turn cap is attached to the first airfoil platform, and a first suction-side turn passage fluidly connecting the first suction side airfoil passage to the merging chamber when the turn cap is attached to the first airfoil platform. Each of the first suction-side turn passage and the first pressure-side turn passage turn a direction of fluid flow from a first direction to a second direction such that a fluid flow exiting the first suction-side turn passage and the first pressure-side turn passage are aligned when entering the merging chamber.

In addition to one or more of the features described herein, or as an alternative, further embodiments of the airfoil may include that the hollow body, the first airfoil platform, and the first turn cap are integrally formed.

In addition to one or more of the features described herein, or as an alternative, further embodiments of the airfoil may include that the first suction-side turn passage and the first pressure-side turn passage form a first turning feature within the turn cap, the turn cap further comprising a second turning feature.

In addition to one or more of the features described herein, or as an alternative, further embodiments of the airfoil may include that the turn cap further includes a first divider fluidly separating the first turning feature from the second turning feature.

In addition to one or more of the features described herein, or as an alternative, further embodiments of the airfoil may include that the turn cap further includes a first merging passage fluidly located between (i) outlets of the first suction-side turn passage and the first pressure-side turn passage and (ii) the merging chamber.

In addition to one or more of the features described herein, or as an alternative, further embodiments of the airfoil may include that at least one of the first pressure-side turn passage and the first suction-side turn passage has an inlet that fluidly connects to the first up-pass cavity when the turn cap is attached to the first airfoil platform, an outlet that fluidly connects to the merging chamber, a first sidewall, a second sidewall, a first turning surface, and a second turning surface. Each of the first sidewall, the second sidewall, the first turning surface, and the second turning surface extend from the inlet to the outlet.

In addition to one or more of the features described herein, or as an alternative, further embodiments of the airfoil may include that the inlet has a first aspect ratio that matches an aspect ratio of the first up-pass cavity and the outlet has a second aspect ratio.

In addition to one or more of the features described herein, or as an alternative, further embodiments of the airfoil may include that the first aspect ratio and the second aspect ratio are different.

In addition to one or more of the features described herein, or as an alternative, further embodiments of the airfoil may include that the second aspect ratio is less than four times the first aspect ratio.

In addition to one or more of the features described herein, or as an alternative, further embodiments of the airfoil may include that at least one of the first pressure-side turn passage and the first suction-side turn passage has an angular surface rotation turning rate or twist defined with a maximum twist angle per unit distance along a centerline of the respective passage.

In addition to one or more of the features described herein, or as an alternative, further embodiments of the airfoil may include that the maximum angular surface rotation turning rate or twist angle is 25° and the unit distance is 0.100 inches.

In addition to one or more of the features described herein, or as an alternative, further embodiments of the airfoil may include a "space-eater" baffle positioned in at least one of the up-pass cavities.

In addition to one or more of the features described herein, or as an alternative, further embodiments of the airfoil may include a second up-pass cavity within the hollow body having a respective second pressure side airfoil passage and a respective second suction side airfoil passage, a second up-pass cavity opening formed in the non-gas path surface of the first airfoil platform fluidly connected to the second up-pass cavity, and the first turn cap covering the second up-pass cavity opening. the first turn cap having a second pressure-side turn passage fluidly connecting the second pressure side airfoil passage to the merging chamber when the turn cap is attached to the first airfoil platform and a second suction-side turn passage fluidly connecting the second suction side airfoil passage to the merging chamber when the turn cap is attached to the first airfoil platform. Each of the second suction-side turn passage and the second pressure-side turn passage turn a direction of fluid flow from a first direction to a second direction such that a fluid flow exiting the second suction-side turn passage and the second pressure-side turn passage are aligned when entering the merging chamber.

According to some embodiments, turn caps for airfoils of gas turbine engines are provided. The turn caps include a first pressure-side turn passage extending from a respective inlet to a respective outlet within the turn cap, a first suction-side turn passage extending from a respective inlet to a respective outlet within the turn cap, and a merging chamber fluidly connected to the outlets of the first pressure-side turn passage and the first suction-side turn passage. Each of the first suction-side turn passage and the first pressure-side turn passage turn a direction of fluid flow from a first direction to a second direction such that a fluid flow exiting the first suction-side turn passage and the first pressure-side turn passage are aligned when entering the merging chamber.

In addition to one or more of the features described herein, or as an alternative, further embodiments of the turn caps may include that the first suction-side turn passage and the first pressure-side turn passage form a first turning feature within the turn cap, the turn cap further comprising a second turning feature.

In addition to one or more of the features described herein, or as an alternative, further embodiments of the turn caps may include a first divider fluidly separating the first turning feature from the second turning feature.

In addition to one or more of the features described herein, or as an alternative, further embodiments of the turn caps may include a first merging passage fluidly located between (i) outlets of the first suction-side turn passage and the first pressure-side turn passage and (ii) the merging chamber.

In addition to one or more of the features described herein, or as an alternative, further embodiments of the turn caps may include that at least one of the first pressure-side turn passage and the first suction-side turn passage has a first sidewall extending from the inlet to the outlet, a second sidewall extending from the inlet to the outlet, a first turning surface extending from the inlet to the outlet, and a second turning surface extending from the inlet to the outlet. The inlet is oriented in a first direction and the outlet is oriented in a second direction different from the first direction.

In addition to one or more of the features described herein, or as an alternative, further embodiments of the turn caps may include that the inlet has a first aspect ratio and the outlet has a second aspect ratio that is different from the first aspect ratio.

In addition to one or more of the features described herein, or as an alternative, further embodiments of the turn caps may include that at least one of the first pressure-side turn passage and the first suction-side turn passage has an angular surface rotation turning rate or twist defined with a maximum twist angle per unit distance along a centerline of the respective passage.

Technical effects of embodiments of the present disclosure include turn caps to be installed to or formed with platforms of airfoils to provide turning paths to improve the convective cooling of the airfoil within airfoil bodies and more particularly aid in turning airflows to enable low- or no-loss merging of multiple air streams within a turn cap. Further, technical effects include turn caps having angular surface rotation turning rate or twisted turn passages that are configured to turn airflow passing through an airfoil from one direction to another in a manner that minimizes and/or eliminates losses.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be illustrative and explanatory in nature and non-limiting.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1A:
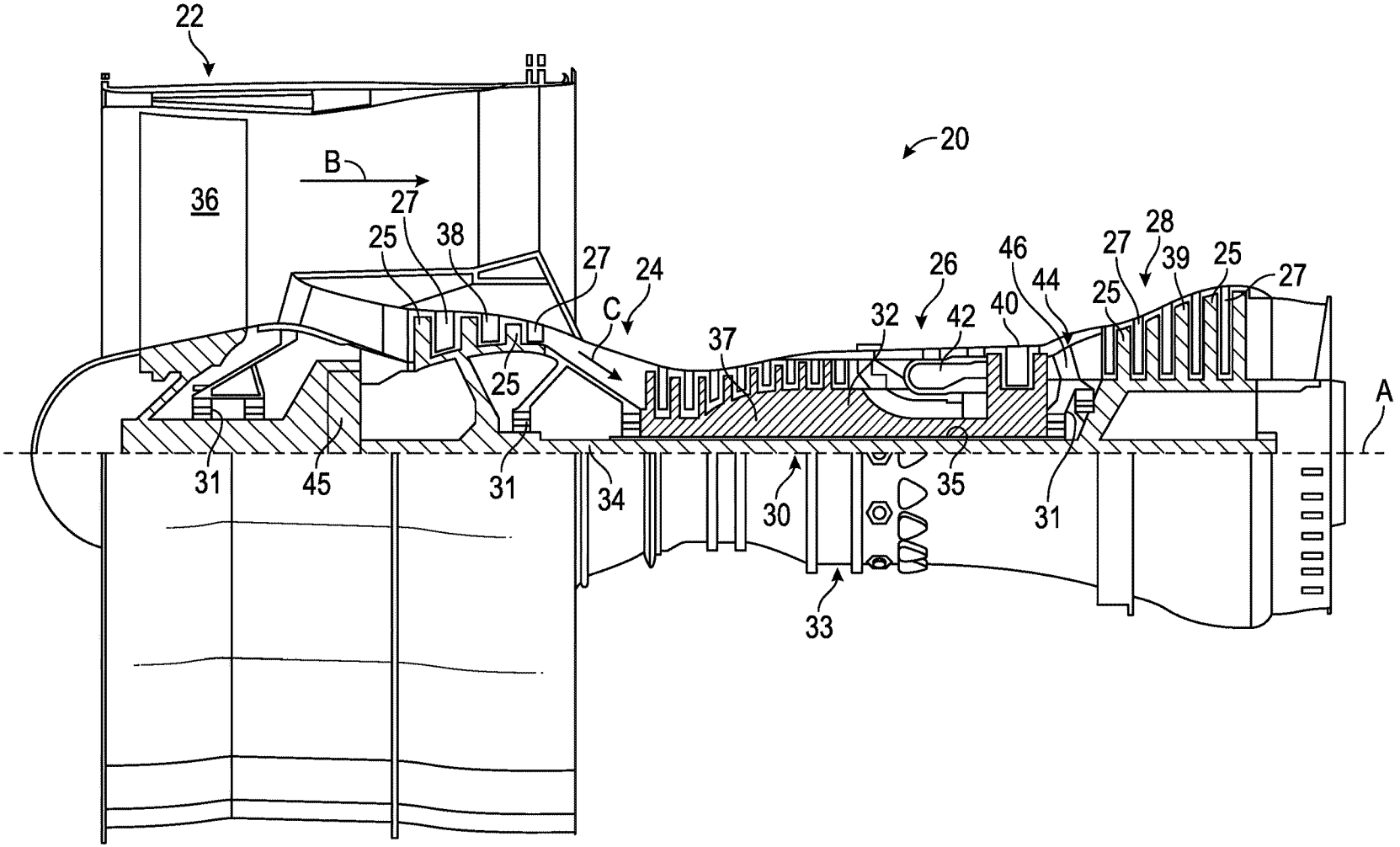
FIG. 1A is a schematic cross-sectional view of a gas turbine engine that may employ various embodiments disclosed herein.

FIG. 1A schematically illustrates a gas turbine engine 20. The exemplary gas turbine engine 20 is a two-spool turbofan engine that generally incorporates a fan section 22, a compressor section 24, a combustor section 26, and a turbine section 28. Alternative engines might include an augmenter section (not shown) among other systems for features. The fan section 22 drives air along a bypass flow path B, while the compressor section 24 drives air along a core flow path C for compression and communication into the combustor section 26. Hot combustion gases generated in the combustor section 26 are expanded through the turbine section 28. Although depicted as a turbofan gas turbine engine in the disclosed non-limiting embodiment, it should be understood that the concepts described herein are not limited to turbofan engines and these teachings could extend to other types of engines, including but not limited to, single-spool, three-spool, etc. engine architectures.

The gas turbine engine 20 generally includes a low speed spool 30 and a high speed spool 32 mounted for rotation about an engine centerline longitudinal axis A. The low speed spool 30 and the high speed spool 32 may be mounted relative to an engine static structure 33 via several bearing systems 31. It should be understood that other bearing systems 31 may alternatively or additionally be provided.

The low speed spool 30 generally includes an inner shaft 34 that interconnects a fan 36, a low pressure compressor 38 and a low pressure turbine 39. The inner shaft 34 can be connected to the fan 36 through a geared architecture 45 to drive the fan 36 at a lower speed than the low speed spool 30. The high speed spool 32 includes an outer shaft 35 that interconnects a high pressure compressor 37 and a high pressure turbine 40. In this embodiment, the inner shaft 34 and the outer shaft 35 are supported at various axial locations by bearing systems 31 positioned within the engine static structure 33.

A combustor 42 is arranged between the high pressure compressor 37 and the high pressure turbine 40. A mid-turbine frame 44 may be arranged generally between the high pressure turbine 40 and the low pressure turbine 39. The mid-turbine frame 44 can support one or more bearing systems 31 of the turbine section 28. The mid-turbine frame 44 may include one or more airfoils 46 that extend within the core flow path C.

The inner shaft 34 and the outer shaft 35 are concentric and rotate via the bearing systems 31 about the engine centerline longitudinal axis A, which is co-linear with their longitudinal axes. The core airflow is compressed by the low pressure compressor 38 and the high pressure compressor 37, is mixed with fuel and burned in the combustor 42, and is then expanded over the high pressure turbine 40 and the low pressure turbine 39. The high pressure turbine 40 and the low pressure turbine 39 rotationally drive the respective high speed spool 32 and the low speed spool 30 in response to the expansion.

The pressure ratio of the low pressure turbine 39 can be pressure measured prior to the inlet of the low pressure turbine 39 as related to the pressure at the outlet of the low pressure turbine 39 and prior to an exhaust nozzle of the gas turbine engine 20. In one non-limiting embodiment, the bypass ratio of the gas turbine engine 20 is greater than about ten (10:1), the fan diameter is significantly larger than that of the low pressure compressor 38, and the low pressure turbine 39 has a pressure ratio that is greater than about five (5:1). It should be understood, however, that the above parameters are only examples of one embodiment of a geared architecture engine and that the present disclosure is applicable to other gas turbine engines, including direct drive turbofans.

In this embodiment of the example gas turbine engine 20, a significant amount of thrust is provided by the bypass flow path B due to the high bypass ratio. The fan section 22 of the gas turbine engine 20 is designed for a particular flight condition—typically cruise at about 0.8 Mach and about 35,000 feet. This flight condition, with the gas turbine engine 20 at its best fuel consumption, is also known as bucket cruise Thrust Specific Fuel Consumption (TSFC). TSFC is an industry standard parameter of fuel consumption per unit of thrust.

Fan Pressure Ratio is the pressure ratio across a blade of the fan section 22 without the use of a Fan Exit Guide Vane system. The low Fan Pressure Ratio according to one non-limiting embodiment of the example gas turbine engine 20 is less than 1.45. Low Corrected Fan Tip Speed is the actual fan tip speed divided by an industry standard temperature correction of $[(T_{ram}\ ^\circ\ R)/(518.7^\circ\ R)]^{0.5}$, where T represents the ambient temperature in degrees Rankine. The Low Corrected Fan Tip Speed according to one non-limiting embodiment of the example gas turbine engine 20 is less than about 1150 fps (351 m/s).

Each of the compressor section 24 and the turbine section 28 may include alternating rows of rotor assemblies and vane assemblies (shown schematically) that carry airfoils that extend into the core flow path C. For example, the rotor assemblies can carry a plurality of rotating blades 25, while each vane assembly can carry a plurality of vanes 27 that extend into the core flow path C. The blades 25 of the rotor assemblies create or extract energy (in the form of pressure) from the core airflow that is communicated through the gas turbine engine 20 along the core flow path C. The vanes 27 of the vane assemblies direct the core airflow to the blades 25 to either add or extract energy.

Various components of a gas turbine engine 20, including but not limited to the airfoils of the blades 25 and the vanes 27 of the compressor section 24 and the turbine section 28, may be subjected to repetitive thermal cycling under widely ranging temperatures and pressures. The hardware of the turbine section 28 is particularly subjected to relatively extreme operating conditions. Therefore, some components may require internal cooling circuits for cooling the parts during engine operation. Example cooling circuits that include features such as partial cavity baffles are discussed below.

Figure 1B:
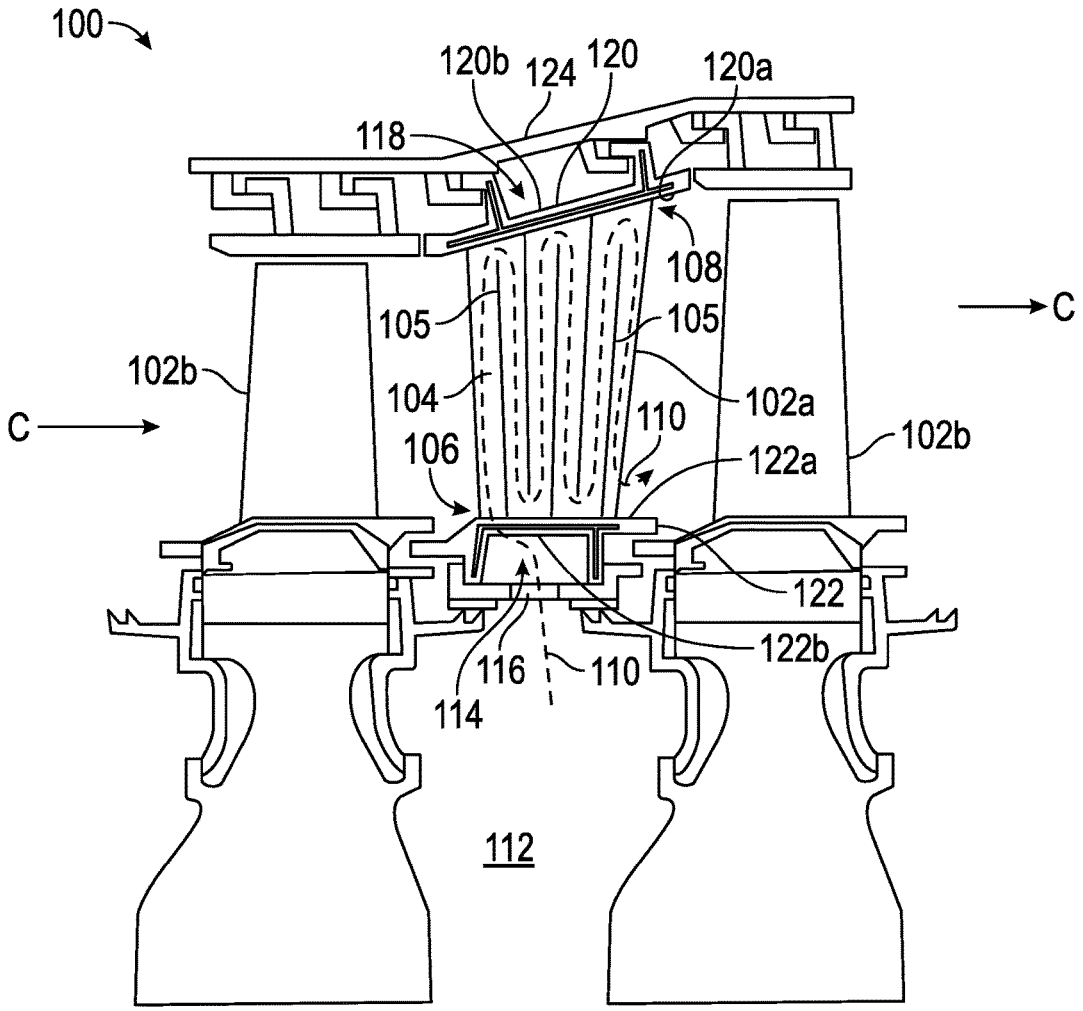
FIG. 1B is a partial schematic view of a turbine section of the gas turbine engine of FIG. 1A.

FIG. 1B is a partial schematic view of a turbine section 100 that may be part of the gas turbine engine 20 shown in FIG. 1A. Turbine section 100 includes one or more airfoils 102*a*, 102*b*. As shown, some airfoils 102*a* are stationary stator vanes and other airfoils 102*b* are blades of turbines disks. The airfoils 102*a*, 102*b* are hollow body airfoils with one or more internal cavities defining a number of cooling channels 104 (schematically shown in vane 102*a*). The airfoil cavities 104 are formed within the airfoils 102*a*, 102*b* and extend from an inner diameter 106 to an outer diameter 108, or vice-versa. The airfoil cavities 104, as shown in the vane 102*a*, are separated by partitions 105 that extend either from the inner diameter 106 or the outer diameter 108 of the vane 102*a*. The partitions 105, as shown, extend for a portion of the length of the vane 102*a* to form a serpentine passage within the vane 102*a*. As such, the partitions 105 may stop or end prior to forming a complete wall within the vane 102*a*. Thus, each of the airfoil cavities 104 may be fluidly connected. In other configurations, the partitions 105 can extend the full length of the respective airfoil. Although not shown, those of skill in the art will appreciate that the blades 102*b* can include similar cooling passages formed by partitions therein.

As shown, counting from a leading edge on the left, the vane 102*a* may include six airfoil cavities 104 within the hollow body: a first airfoil cavity on the far left followed by a second airfoil cavity immediately to the right of the first airfoil cavity and fluidly connected thereto, and so on. Those of skill in the art will appreciate that the partitions 105 that separate and define the airfoil cavities 104 are not usually visible and FIG. 1B is merely presented for illustrative and explanatory purposes.

The airfoil cavities 104 are configured for cooling airflow to pass through portions of the vane 102*a* and thus cool the vane 102*a*. For example, as shown in FIG. 1B, an airflow path 110 is indicated by a dashed line. In the configuration of FIG. 1B, air flows from a rotor cavity 112 and into an airfoil inner diameter cavity 114 through an orifice 116. The air then flows into and through the airfoil cavities 104 as indicated by the airflow path 110. Positioned at the outer diameter of the airfoil 102, as shown, is an outer diameter cavity 118.

As shown in FIG. 1B, the vane 102*a* includes an outer diameter platform 120 and an inner diameter platform 122. The vane platforms 120, 122 are configured to enable attachment within and to the gas turbine engine. For example, as appreciated by those of skill in the art, the inner diameter platform 122 can be mounted between adjacent rotor disks and the outer diameter platform 120 can be mounted to a case 124 of the gas turbine engine. As shown, the outer diameter cavity 118 is formed between the case 124 and the outer diameter platform 120. Those of skill in the art will appreciate that the outer diameter cavity 118 and the inner diameter cavity 114 are outside of or separate from the core flow path C. The cavities 114, 118 are separated from the core flow path C by the platforms 120, 122. Thus, each platform 120, 122 includes a respective core gas path surface 120*a*, 122*a* and a non-gas path surface 120*b*, 122*b*. The body of the vane 102*a* extends from and between the gas path surfaces 120*a*, 122*a* of the respective platforms 120, 122. In some embodiments, the platforms 120, 122 and the body of the vane 102*a* are a unitary body.

Air is passed through the airfoil cavities of the airfoils to provide cooling airflow to prevent overheating of the airfoils and/or other components or parts of the gas turbine engine. The flow rate through the airfoil cavities may be a relatively low flow rate of air and because of the low flow rate, the convective cooling and resultant internal heat transfer coefficient may be too low to achieve the desired metal temperatures of the airfoils. One solution to this is to add one or more baffles into the airfoil cavities. That is, in order to achieve desired metal temperatures to meet airfoil full-life with the cooling flow allocated based on turbine engine design, "space-eater" baffles may be used inside airfoil serpentine cooling passages (e.g., within the airfoil cavities 104 shown in FIG. 1B). In this instance, the "space-eater" baffle serves as a way to consume internal cavity area/volume in order to reduce the available cross-sectional area through which air can flow. This enables the local flow per unit area to be increased which in turn results in higher cooling cavity Reynolds Numbers and internal convective heat transfer. In some of these configurations, the serpentine turns must be located outside the gas path endwalls (e.g., outside of the airfoil body) to allow the "space-eater" baffles to extend all the way to the gas path endwall. That is, the "space-eater" baffles may be required to extend into the outer diameter cavity 118 or the inner diameter cavity 114. In some circumstances, depending upon the method of manufacture, the radial cooling cavities 104 must be accessible to allow for the insertion of the "space-eater" baffles. However, those of skill in the art will appreciate that if the airfoil cooling configurations are fabricated using alternative additive manufacturing processes and/or fugitive core casting processes the "space-eater" baffles may be fabricated as an integral part or component of the internal convective cooling design concurrently with the rest of the core body and cooling circuit.

Additionally, as will be appreciated by those of skill in the art, a cooling scheme generally requires the merging of cooling flow from several radial passages extending along the pressure and suction sides of the airfoil with minimum pressure loss. For example, a cooling flow from the leading edge-most passages of the airfoil must be able to get to the trailing edge passage(s) with as little pressure loss as possible, e.g., as traveling from the leading edge on the left of the airfoil 102*a* in FIG. 1B to the trailing edge on the right of the airfoil 102*a*. Alternatively, in some embodiments, the direction of the serpentine flow may flow from the trailing edge-most passages of the airfoil toward the leading edge passage(s) with as little pressure loss as possible. To avoid unnecessary turbulence generated by the merging of multi-directional air flow streams that are flowing with varying velocities and pressures, the cooling flow must remain in each passage as it transitions from radial flow to axial flow (e.g., moving in a direction from leading edge toward trailing edge of the airfoil or, conversely, from trailing edge toward the leading edge of the airfoil). Depending on the particular configuration of the turbine, housing, engine, etc., there may be a limited radial distance to merge the cooling flow, particularly when transitioning from one direction or orientation of flow to another direction or orientation of flow.

In cooling passages, the channel defining the passage has an aspect ratio associated or defined by the dimensions of the channel that are perpendicular to the flow direction. As will be appreciated by those of skill in the art, the term aspect ratio is typically used to define the relationship between the dimensions of a channel perpendicular to the flow direction. As used herein, the name of an aspect ratio will refer to the orientation of the longest dimension perpendicular to the flow direction. For example, an "axial aspect ratio" means the longest dimension that is perpendicular to the flow direction (e.g., $W_1$ in FIG. 2B) is in an axial orientation. A "circumferential aspect ratio" means the longest dimension that is perpendicular to the flow direction (e.g., $W_2$ in FIG. 2C) is in a circumferential orientation. A "radial aspect ratio" means the longest dimension that is perpendicular to the flow direction is in a radial orientation.

For example, with reference to FIG. 1B, the leading edge passage of airflow path 110 through the airfoil 102*a* flows radially outward (upward on the page) from the inner diameter 106 to the outer diameter 108. Thus, in this instance, the airflow passing through the leading edge passage is in a radial flow direction. As such, the dimensions that define aspect ratio of the channel defining the leading edge passage would be in an axial orientation (i.e., left-to-right on the page) and a circumferential orientation (i.e., in and out of the page). In one example, for illustrating and explaining the nomenclature related to aspect ratios, the axial dimension of this leading channel is longer than the circumferential dimension. That is, the left-to-right dimension is longer than the dimension of the channel in the direction into/out of the page (e.g., from a pressure side to a suction side, as will be appreciated by those of skill in the art). Because the axial dimension is the longer of the dimensions that is perpendicular to a flow direction through the leading edge channel, the leading edge channel has an "axial aspect ratio."

Accordingly, as noted above and as used herein, the "name" of an aspect ratio is defined as the direction of the longest dimension of a channel that is perpendicular to a direction of flow through the channel (e.g., axial, radial, circumferential). Thus, as described above, an aspect ratio of a channel within an airfoil having air flowing from the inner diameter to the outer diameter has a radial flow direction. With a "space-eater" baffle installed within such an airfoil, the longest dimension that is perpendicular to the flow direction is the axially oriented dimension and the circumferentially oriented dimension is the shorter dimension. As such, the channel has an "axial aspect ratio." An axial aspect ratio can also have a direction of cooling flow in a circumferential direction, with the shorter dimension of the channel having a radial orientation. A "circumferential aspect ratio" channel is one that has a flow direction in either the radial or axial flow direction, with the longest dimension of the channel that is perpendicular to the flow direction having a circumferential orientation. Similarly, a "radial aspect ratio" channel is one that has an axial or circumferential flow direction, with the longest dimension of the channel that is perpendicular to the flow direction being circumferentially oriented.

The above described limited radial distance at the turning of airflows passing through airfoils may alter the direction of the channels and, thus, the associated aspect ratios. For example when transitioning from a radial flow direction to an axial flow direction, a flow passage may transition from an axial aspect ratio channel to a circumferential aspect ratio channel. Once all the internal cooling flow is travelling in the same predominantly axial streamwise direction, it can be merged.

Referencing FIGS. 2A-2D, schematic illustration of an airfoil 202 configured in accordance with an embodiment of the present disclosure is shown. The airfoil 202 may be a vane and similar to that shown and described above having a body that extends from an inner diameter platform 222 to an outer diameter platform 220. The airfoil 202 extends from a gas path surface 220*a* of the outer diameter platform 220 to a gas path surface 222*a* of the inner diameter platform 222.

The airfoil 202 includes a plurality of interior airfoil cavities, with a first airfoil cavity 204*a* being an up pass of a serpentine cavity, a second airfoil cavity 204*b* being a down pass of the serpentine cavity, and a third airfoil cavity 204*c* being a trailing edge cavity. The airfoil 202 also includes a fourth airfoil cavity 204*d* that is a leading edge cavity. As illustratively shown, a cooling flow of air can follow an airflow path 210 by entering the airfoil 202 from the inner diameter, flowing radially outward to the outer diameter through the up pass of the first airfoil cavity 204*a*, turning at the outer diameter turning cavity 246, downward through the down pass of the second airfoil cavity 204*b*, turning at the inner diameter turning cavity 248, and then radially outward and out through the third airfoil cavity 204*c*. As shown, the first and second airfoil cavities 204*a*, 204*b* are configured with baffles 238*a*, 238*b* inserted therein.

To provide sufficient cooling flow and control of cooling air pressure within the airflow path 210, the airfoil 202 is provided with a first turn cap 242 and a second turn cap 244. The first turn cap 242 defines a first turning cavity 246 therein. Similarly, the second turn cap 244 defines a second turning cavity 248 therein. As illustratively shown, the first turn cap 242 is positioned at an outer diameter 208 of the airfoil 202 and fluidly connects the first airfoil cavity 204*a* with the second airfoil cavity 204*b*. The second turn cap 244 is positioned at an inner diameter 206 of the airfoil 202 and fluidly connects the second airfoil cavity 204*b* with the third airfoil cavity 204*c*. The first and second turning cavities 246, 248 define portions of the cooling airflow path 210 used for cooling the airfoil 202. The turn caps 242, 244 are attached to respective non-gas path surfaces 220*b*, 222*b* of the platforms 220, 222.

Figure 2A:
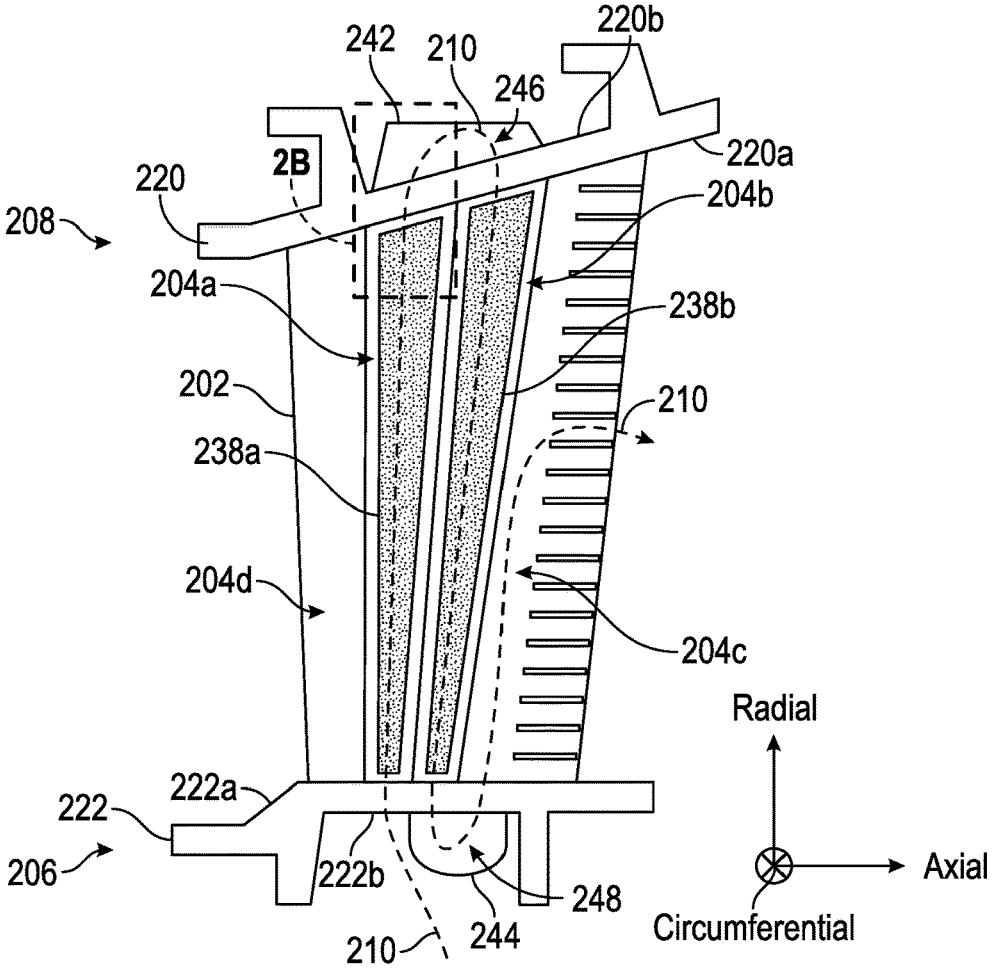
FIG. 2A is a schematic illustration of an airfoil configured in accordance with a non-limiting embodiment of the present disclosure.

The first and second turn caps 242, 244 move the turn of the airflow path 210 outside of the airfoil and into the cavities external to the airfoil (e.g., within outer diameter cavity 118 and inner diameter cavity 114 shown in FIG. 1B) and outside the hot gas path region which is typically constrained between the outer diameter and inner diameter gas path surfaces 220*a*, 222*a* of the respective platforms 220, 222, as shown in FIG. 2A. As such, there is significantly lower heat flux that exists outside of the hot gas path region. In this embodiment, the first and second turn caps 242, 244 serve as conduits for the internal cooling air flow to be transitioned toward the outer perimeter of the "space-eater" baffles 238*a*, 238*b*. In this instance, the "space eater" baffles consume a significant portion of the unobstructed cooling channels creating significantly smaller cooling channels 204*a* immediately adjacent to the external airfoil side wall surfaces along the entire radial distance of the airfoil surface (as shown in FIG. 2D). The redirection of cooling air flow around the perimeter of the "space-eater" baffles into the smaller cross-sectional area cooling channels 204*a*, 204*b* enables significantly higher internal cooling air flow Reynolds Numbers to be obtained. The increase in cooling air flow per unit area results in a higher internal convective heat transfer coefficient to be achieved along the entire radial cooling cavity immediately adjacent to the surface of an airfoil external sidewall 205 within the body of the airfoil 202 (as shown in FIG. 2D). In this embodiment, the turn caps 242, 244 are manufactured as separate parts or pieces that are welded or otherwise fixedly attached to the platforms 220, 222.

As shown illustratively, the first turn cap 242 and the second turn cap 244 have different geometric shapes. The turn caps in accordance with the present disclosure can take various different geometric shapes such that a desired air flow and pressure loss characteristics can be achieved. For example, a curved turn cap may provide improved and/or controlled airflow at the turn outside of the airfoil body. Other geometries may be employed, for example, to accommodate other considerations within the gas turbine engine, such as fitting between the platform and a case of the engine. Further, various manufacturing considerations may impact turn cap shape. For example, flat surfaces are easier to fabricate using sheet metal, and thus it may be cost effective to have flat surfaces of the turn caps, while still providing sufficient flow control.

Figure 2B:
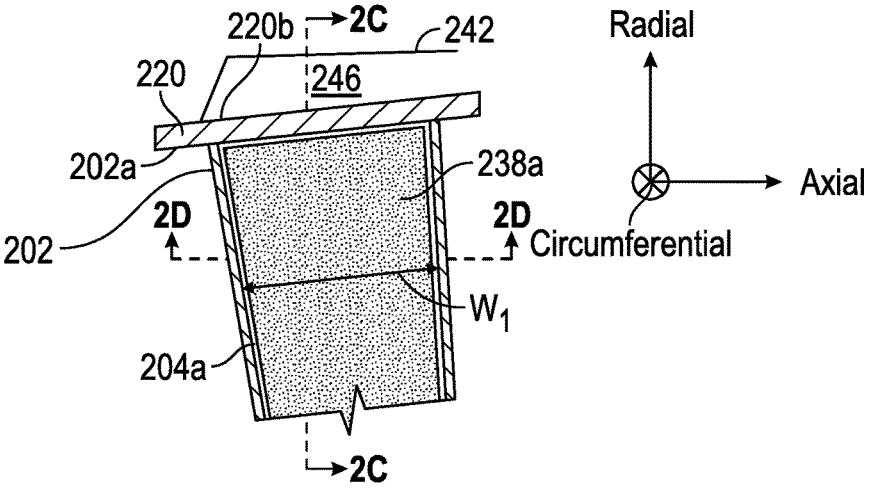
FIG. 2B is an enlarged illustration of a portion of the airfoil of FIG. 2A as indicated in the box 2B of FIG. 2A.
Figure 2C:
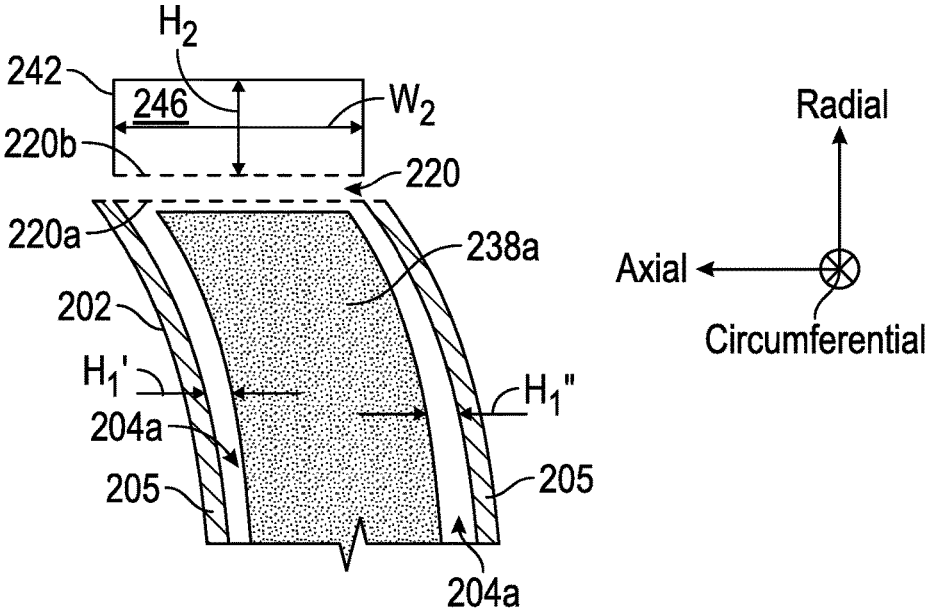
FIG. 2C is a cross-sectional illustration of the airfoil of FIG. 2A as viewed along the line 2C-2C of FIG. 2B.
Figure 2D:
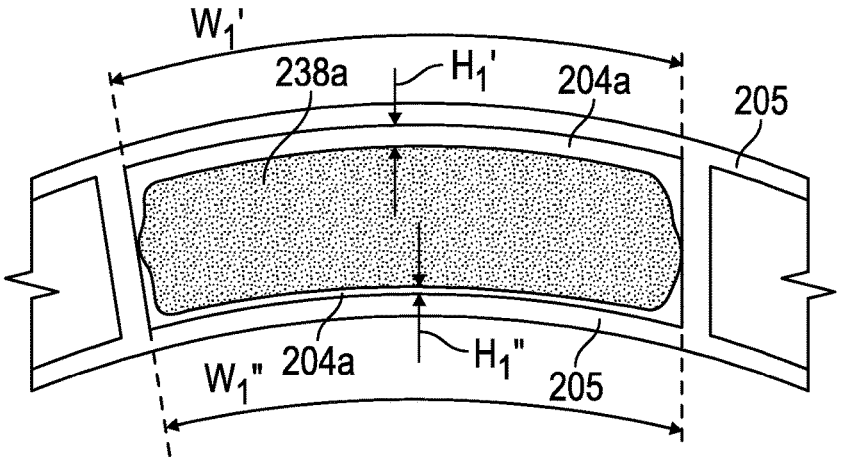
FIG. 2D is a cross-sectional illustration of the airfoil of FIG. 2A as viewed along the line 2D-2D of FIG. 2B.

As shown in FIGS. 2B-2C, enlarged illustrations of a portion of the airfoil 202 of FIG. 2A are shown. FIG. 2B illustrates an enlarged illustration of the box 2B indicated in FIG. 2A and FIG. 2C is a cross-sectional illustration along the line 2C-2C shown in FIG. 2B. As shown in FIG. 2B, the airfoil 202 includes the baffle 238*a* disposed within first airfoil cavity 204*a*. The airfoil 202 extends radially inward (relative to an axis of an engine) as indicated by the key shown in FIGS. 2A-2C. In FIGS. 2A-2C, the radial direction is outward relative to an engine axis (e.g., engine centerline longitudinal axis A shown in FIG. 1A) and is illustrated as radially outward (upward on the page) of FIGS. 2A-2C. The axial direction is along the engine axis and is shown indicated to the right in FIGS. 2A-2B and into the page of FIG. 2C. Those of skill in the art will appreciate that a circumferential direction is to the left/right in FIG. 2C (into/out of page of FIGS. 2A-2B).

As shown in FIGS. 2B-2D, air flowing through the first airfoil cavity 204*a* and into the first turning cavity 246 will change in aspect ratios with respect to the channel through which the flow passes. For example, when passing radially outward (upward on the page) within the first airfoil cavity 204*a*, the airflow will pass through a channel (e.g., first airfoil cavity 204*a*) defined by the airfoil external sidewalls 205 and the baffle 238*a*. The first airfoil cavity 204*a* and the baffle 238*a* define an axial aspect ratio of height-to-width of the channel. In this case the airflow channel has a first height $H_1'$, $H_1''$ which is a distance between a surface of the baffle 238*a* and a surface of an airfoil external sidewall 205 in the circumferential direction. As shown, and as will be appreciated by those of skill in the art, the first height $H_1'$, $H_1''$ can be different on the suction and pressure sides of the baffle 238*a*. However, in some embodiments, the first height $H_1'$, $H_1''$ is the same on both the pressure and suction airfoil external sidewalls 205. As shown in FIGS. 2B-2D, the first airfoil cavity 204*a* can have first width $W_1'$, $W_1''$, which as shown, is a distance in the substantially axial direction.

When the airflow passes into the first turn cap 242, the orientation of the aspect ratio changes to a circumferential aspect ratio channel. In this case, a second height $H_2$ is the height of the first turn cap 242 from the non-gas path surface 220*b* of the platform 220. The width of the airflow channel within the first turn cap 242 (second width $W_2$) is a distance between the pressure side and the suction side of the airfoil, as shown in FIG. 2C. As noted above, the limited radial height within the turn cap (e.g., second height $H_2$) may alter the available aspect ratios for the flow passages and, thus, the flow passage(s) will transition from an axial aspect ratio (within the airfoil) to a circumferential aspect ratio (within the turn cap). Once all the flow is travelling in the same direction, it can be merged.

Figure 3:
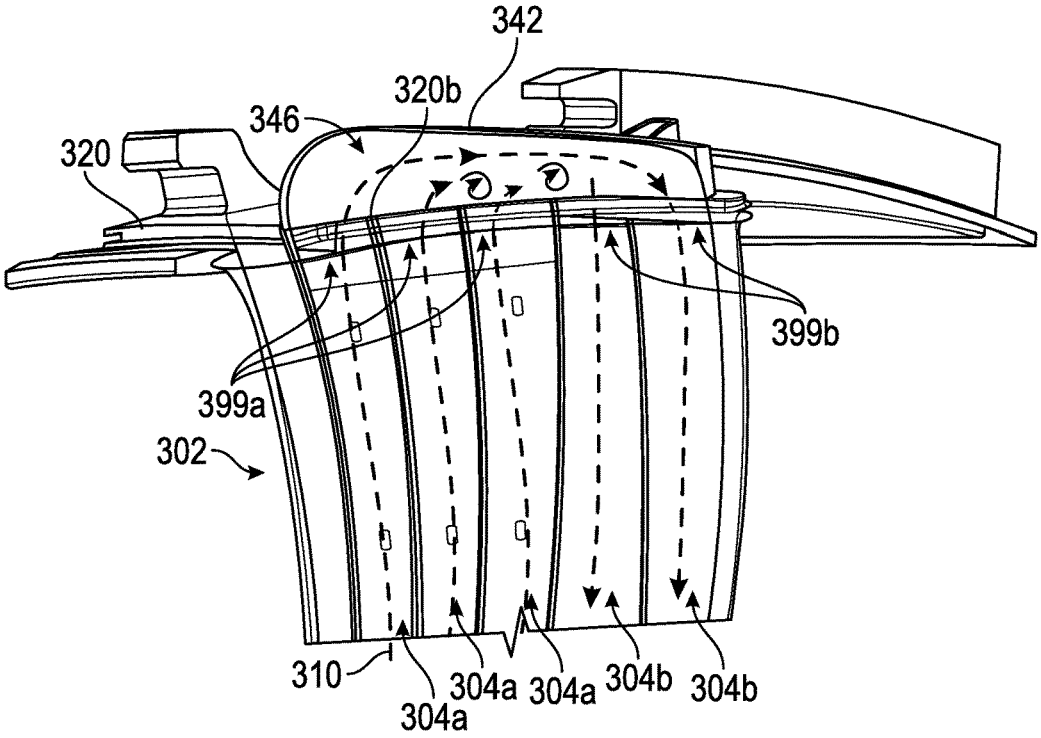
FIG. 3 is a schematic illustration of airflow through an airfoil having a turn cap installed thereto.

Turning now to FIG. 3, a schematic illustration of an airfoil 302 having a turn cap 342 mounted on a non-gas path surface 320*b* of a platform 320 is shown. Cavities of the airfoil 302 are fluidly connected to a turning cavity 346 within the turn cap 342 by means of cavity openings 399*a*, 399*b* that are formed in the platform 320.

As schematically shown, airflow 310 flows radially outward through the airfoil 302 along multiple up-pass first airfoil cavities 304*a*. The airflow passes from the up-pass cavities 304*a* through respective cavity openings 399*a* and into the turning cavity 346 of the turn cap 342. To direct the airflow 310 through cavities 399*b* and into multiple down-pass cavities 304*b*, the turn cap 342 is provided. However, as shown, as the different branches of the airflow 310 enter the turn cap 342 and merge, turbulence (and thus losses) may arise. That is, multiple air flow streams of varying velocities and pressures are merged and travel axially toward the trailing edge of the airfoil 302. Because the different flow streams of airflow 310 enter the turn cap 342 at different positions, some of the airflow will be moving axially (e.g., axially forward-entering air streams) while other streams will be flowing radially (e.g., axially aftward-entering air streams). As a result of the merging of multi-directional flow streams large eddies are generated (as schematically shown in FIG. 3) creating local turbulent vorticities which induce undesired pressure losses in the internal cooling air flow.

Accordingly, as provided herein, turn cap geometry and features are provided within the turn cap to keep the cooling flow separated into the individual passages as the flows transition from a radial flow direction through an airfoil (axial aspect ratio) to an axial flow (circumferential aspect ratio) direction through a turn cap and then back to a radial flow into and through the airfoil. The turn cap dividers are configured and positioned to transition the airflow from the airfoil cavities into the turn cap to enable a smooth transition and merge one or more airflows without incurring significant pressure losses.

Embodiments provided herein are directed to a modified or unique turn cap geometry including an angular surface rotation in order to smoothly transition low aspect ratio channels from axial to circumferential. In some embodiments, each passage may have unique separate angular surface rotation turning rates in order for each of the individual radial (axial aspect ratio) channels to be smoothly transitioned to axial (circumferential aspect ratio) channels within the turn cap. The angular surface rotation turning rate is also dictated by the axial location of the radial (axial aspect ratio) channel relative to the turn cap axial, circumferential, and/or radial position(s). Additionally, the desire to successively radially stack axial (circumferential aspect ratio) channels within the turn cap also dictates the angular turning rate of rotation as a function of streamwise transition of radial (axial aspect ratio) channels to axial (circumferential aspect ratio) channels. In this instance each of the axial (circumferential aspect ratio) channels are separated by circumferential ribs which keep the cooling flow segregated until the internal cavity flows in the turn cap are axially aligned in a streamwise direction prior to being combined in the merging chamber. The numerical aspect ratio of the cooling passage remains similar throughout the turn (although the direction changes). The cooling flow is merged once the two or more passages are aligned in the same direction. The turning cavities or passages may be integrally cast or created by space-eater baffles in the radial passages. In order to allow the space-eater baffles to be inserted, the turning cavities or passages may be created in a separate cap and installed after the baffles are installed or additive manufacturing techniques may be employed.

Figure 4A:
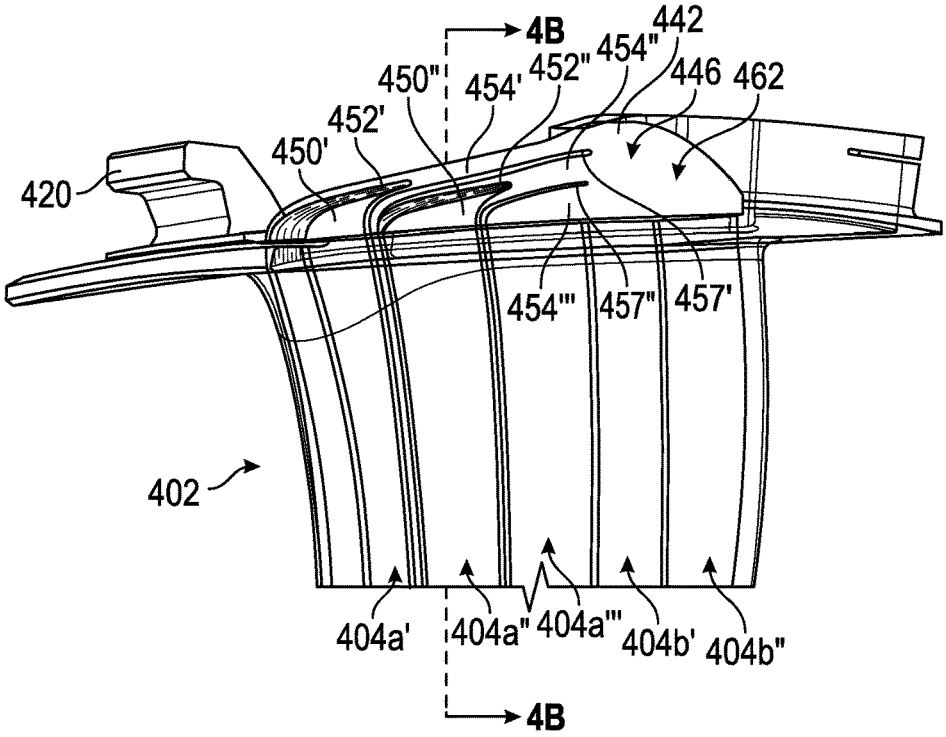
FIG. 4A is a schematic illustration of a turn cap in accordance with an embodiment of the present disclosure as attached to an airfoil.
Figure 4B:
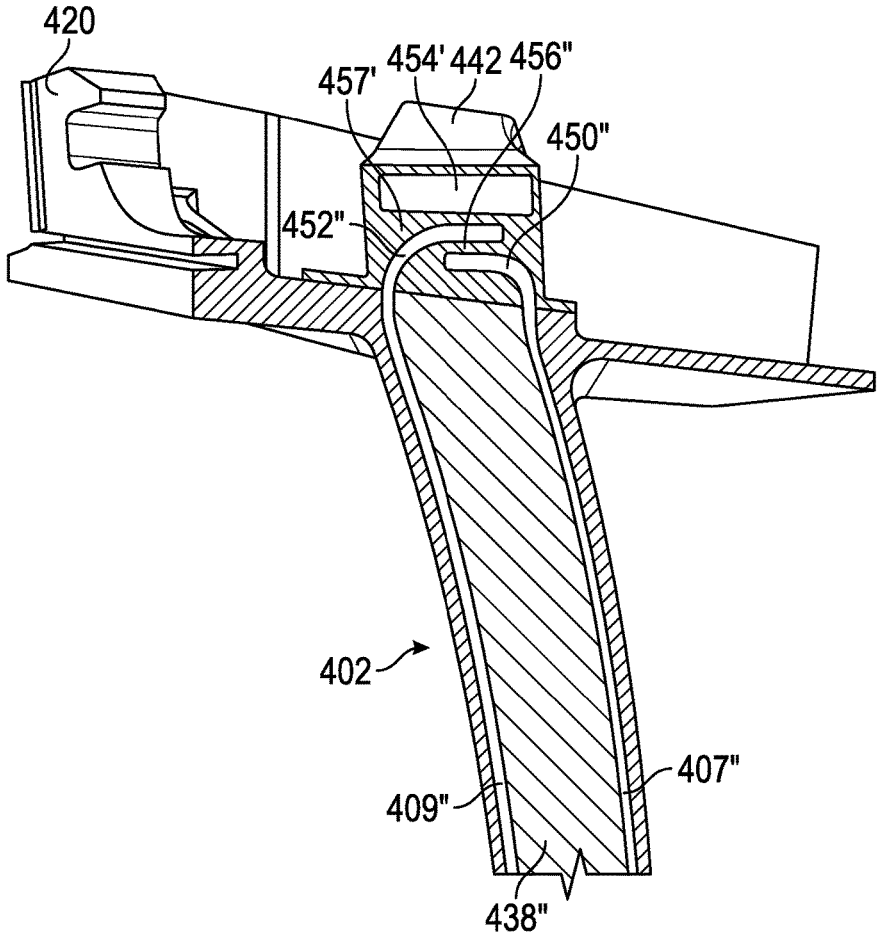
FIG. 4B is a cross-section illustration of the airfoil and turn cap of FIG. 4A as viewed along the line 4B-4B of FIG. 4A.

Turning now to FIGS. 4A-4B, schematic illustrations of an airfoil 402 configured with a turn cap 442 in accordance with an embodiment of the present disclosure are shown. FIG. 4A is a side view illustration of the airfoil 402 and the turn cap 442 and FIG. 4B is a cross-section illustration viewed along the line 4B-4B shown in FIG. 4A. The turn cap 442 is positioned relative to a platform 420 from which the airfoil 402 extends. As shown, the airfoil 402 includes a plurality of first (up-pass) cavities 404*a*', 404*a*", 404*a*'" and second (down-pass) cavities 404*b*', 404*b*". Internal cooling air flows radially outward through the up-pass cavities 404*a*', 404*a*", 404*a*'", turns within the turn cap 442, and is merged prior to flowing radially downward (inward) into and through the down-pass cavities 404*b*', 404*b*".

The turn cap 442 is configured to keep cooling flow streams in each passage (up-pass cavities 404*a*', 404*a*", 404*a*'") segregated until all of the flow streams have turned axial (to the right on the page of FIG. 4A) and are flowing in the same direction (e.g., parallel to each other). Such segregation in the turn can eliminate pressure losses associated with turbulence caused by the merging of multi-directional air flow streams that are flowing with varying velocities and pressures. In addition, embodiments provided herein enable a means of transitioning the cooling passages from an axial aspect ratio to a circumferential aspect ratio in order to fit all of the passages within the limited radial height available within the turn cap.

To separate the flow, the turn cap 442 is configured with multiple turning cavities therein, with the turning cavities separating or dividing up a turning cavity 446 within the turn cap 442. For example, as shown in FIGS. 4A-4B, the turning cavity 446 within the turn cap 442 includes a first pressure-side turn passage 450', a second pressure-side turn passage 450", a first suction-side turn passage 452', and a second suction-side turn passage 452". The first pressure-side turn passage 450' and the first suction-side turn passage 452' form a first turning feature that merges the flows from the pressure and suction sides of the first up-pass 404*a*' into a first merging passage 454'. Similarly, the second pressure-side turn passage 450" and the second suction-side turn passage 452" form a second turning feature that merges the flows from the pressure and suction sides of the second up-pass 404*a*" into a second merging passage 454". The third up-pass 404*a*'", shown in FIG. 4A, does not feed into respective turn passages, but rather airflow from the pressure and suction sides of the third up-pass 404*a*'" feed into a merging passage 454'", as shown. FIG. 4B illustrates a cross-sectional illustration along the line 4B-4B of FIG. 4A, providing additional illustration to the configuration of the turn cap 442. As shown, the pressure and suction side cavities of a turning feature are separated by a respective rib within the turning cap 442. That is, as shown in FIG. 4B, the second pressure-side turn passage 450" is separated from the second suction-side turn passage 452" by a respective rib 456" (e.g., a second rib, with a first rib separating the turning cavities of the first turning feature). Further, each turning feature is separated from an adjacent turning feature by a divider 457 (shown as dividers 457', 457" in FIGS. 4A-4B).

As shown in FIG. 4B, the second pressure-side turn passage 450" is supplied or fed with air that passes through a pressure side airfoil passage 407" (part of second up-pass cavity 404*a*"). Similarly, the second suction-side turn passage 452" is supplied or fed with air that passes through a suction side airfoil passage 409" (part of second up-pass cavity 404*a*"). In the arrangement of FIG. 4B, the pressure side airfoil passage 407" is separated from the suction side airfoil passage 409" by a baffle 438". Although not shown in detail, those of skill in the art will appreciate that the first and third up-pass cavities 404*a*', 404*a*" and the first and second down-pass cavities 404*b*', 404*b*" can include baffles that separate or divide the respective cavities into pressure and suction side airfoil passages similar to that shown in FIG. 4B.

As noted, the turn passages in various embodiments of the present disclosure can merge into merging passages and/or the flow from airfoil passages can be merged within a merging passage, as shown and described herein. The turn passages are arranged to turn and merge flows that feed into the merging passages with the incoming flow being substantially parallel and thus losses can be minimized.

Figure 5:
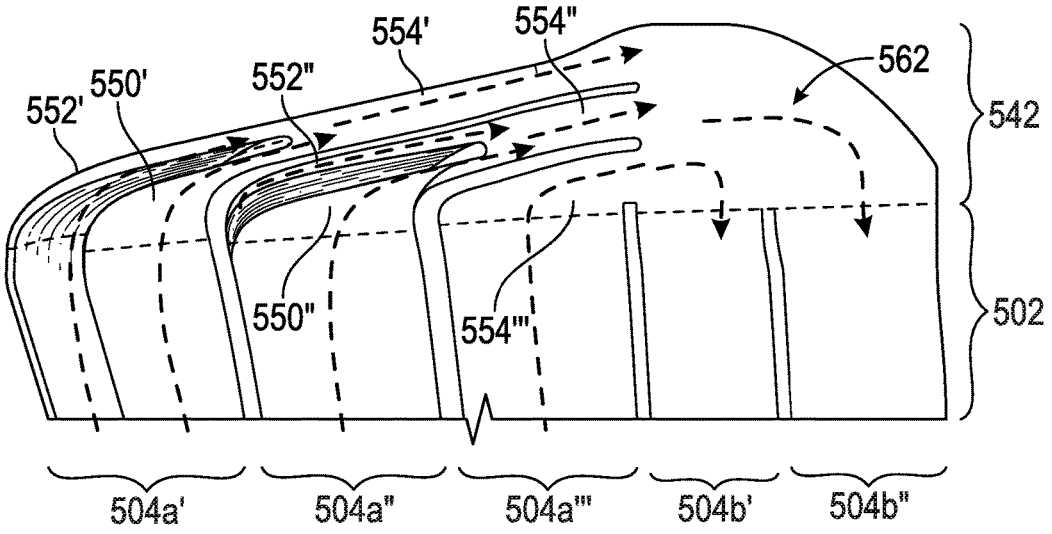
FIG. 5 is a schematic illustration of airflow passages within a turn cap and airfoil in accordance with an embodiment of the present disclosure.

Turning now to FIG. 5, a schematic illustration of airflow through an airfoil 502 and turn cap 542 in accordance with an embodiment of the present disclosure is shown. FIG. 5 is a representation of the flow passages and cavities within the structure of the airfoil 502 and turn cap 542, with the physical structure omitted for purposes of illustration and discussion. Thus, the bounds of the illustration (e.g., "walls") represent the structure of the airfoil 502 and turn cap 542 that define the flow passages and cavities as discussed herein.

As illustratively shown, air will flow radially outward through the first up-pass cavity 504*a*' into the first pressure-side turn passage 550' and the first suction-side turn passage 552'. The air will then be turned within the turn passages 550', 552' and flow parallel within the turn passages 550', 552' to then be merged within the first merging passage 554'. Similarly, air will flow radially outward through the second up-pass cavity 504*a*" into the second pressure-side turn passage 550" and the second suction-side turn passage 552". The air will then be turned within the turn passages 550", 552" and flow parallel within the turn passages 550", 552" to then be merged within the second merging passage 554". Further, air will flow within the third up-pass cavity 504*a*'" to enter and turn within a third merging passage 554'".

The air within the merging passages 554', 554", 554'" will all be flowing in parallel streamwise directions when entering a merging chamber 562. The air within the merging chamber 562 will then flow into down-pass cavities 504*b*', 504*b*", as illustratively shown.

The shape of the turn passages 550, 552 are designed to have an angular surface rotation that smoothly transitions the cooling flow from a radial flow (axial aspect ratio) direction (e.g., radially outward within the up-pass cavities) to an axial flow direction (e.g., within the turn cap). Such a smooth transition enables minimal pressure losses due to disparate direction airflows that are merged within the turn cap. That is, the airflow is directed outward through radial (axial aspect ratio) channels and is then turned through segregated axial (circumferential aspect ratio) channels aligned in a predominantly axial direction and then merged while flowing in the same streamwise direction.

Figure 6A:
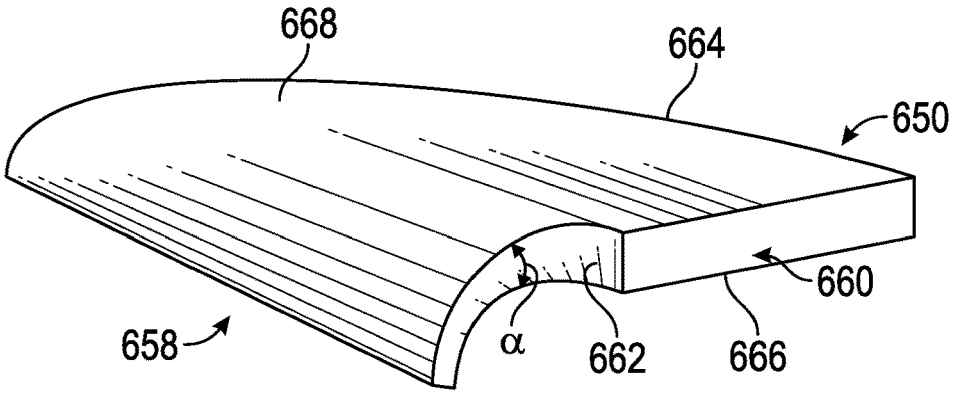
FIG. 6A is an isometric schematic illustration of a turn passage of a turn cap in accordance with an embodiment of the present disclosure.
Figure 6B:
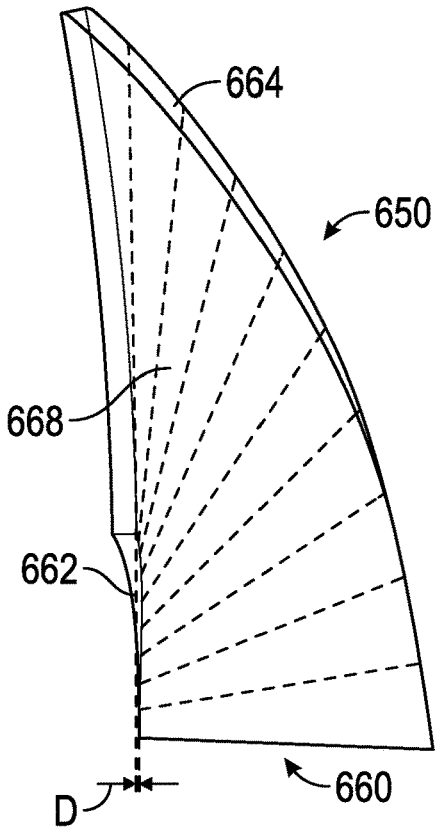
FIG. 6B is a plan view, top down illustration of the turn passage of FIG. 6A.
Figure 6C:
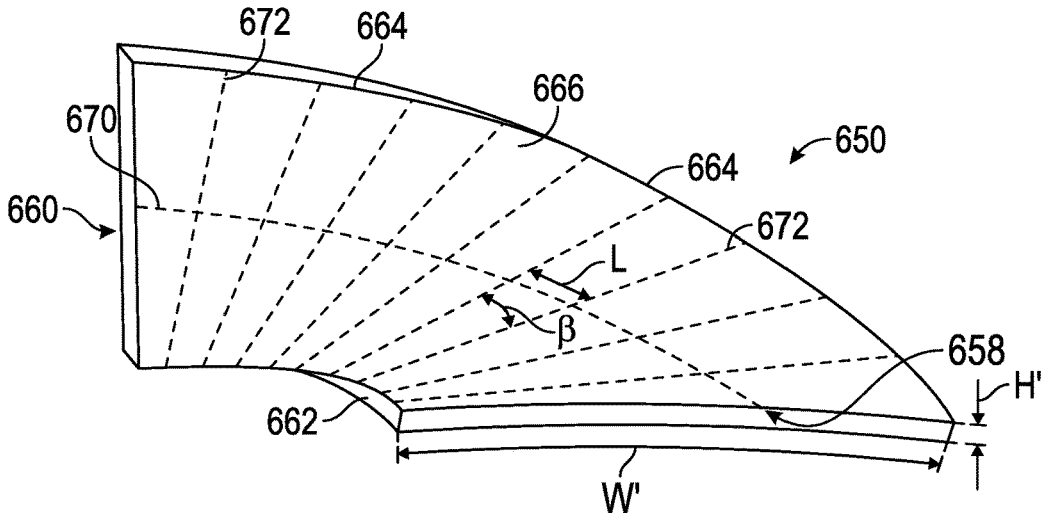
FIG. 6C is a plan view, bottom up illustration of the turn passage of FIG. 6A.
Figure 6D:
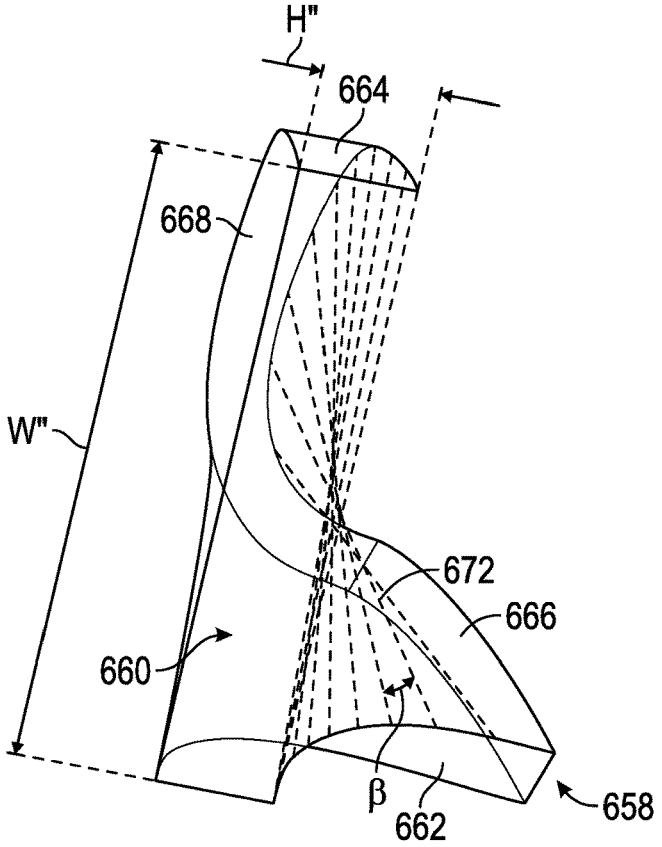
FIG. 6D is an end-on illustration of the turn passage of FIG. 6A.

Turning now to FIGS. 6A-6D, various schematic illustrations of the geometry of a turn passage 650 in accordance with an embodiment of the present disclosure are shown. The turn passage 650 is generically representative of the turn passages shown and described above and is formed within a turn cap that is part of or installed to a platform of an airfoil structure. FIG. 6A is an isometric illustration of the turn passage 650. FIG. 6B is a top-down illustration of the turn passage 650. FIG. 6C is a bottom-up illustration of the turn passage 650. FIG. 6D is an end-on illustration of the turn passage 650 (as viewed toward the exit of the turn passage 650).

With reference to FIGS. 6A-6D, the turn passage 650 has an inlet 658 and outlet 660 defined by a first sidewall 662, a second sidewall 664, a first turning surface 666 (shown in FIGS. 6C-6D), and a second turning surface 668. In some embodiments, the inlet 658 is fluidly connected to an up-pass of an airfoil and the outlet 660 is fluidly connected to a merging passage or merging chamber. The sidewalls 662, 664 and the turning surfaces 666, 668 are arranged to turn flow entering the inlet 658 at a first flow direction (e.g., radial flow direction) to a second flow direction (e.g., axial flow direction). In some arrangements the first flow direction may be perpendicular to the second flow direction, and thus a 90° turn may be achieved using turn passages as described herein.

The inlet 658 has a numerical aspect ratio (although orientation can be different) that is the same as or substantially similar to an aspect ratio of the up-pass cavity that feeds air into the turn passage 650. The inlet 658 has a height H' and a width W', as shown in FIG. 6C, with an aspect ratio of H'/W'. In some embodiments, the aspect ratio of the inlet 658 can be less than 1 (i.e., H'/W'<1). The outlet 660 has a numerical aspect ratio that is the same as or substantially similar to an aspect ratio of merging passage that the outlet 660 feeds air into. The outlet 660 has a height H" and a width W", as shown in FIG. 6D, with an aspect ratio of H"/W". In some embodiments, the aspect ratio of the outlet 660 is equal to the aspect ratio of the inlet 658. However, in other embodiments, such as shown in FIGS. 6A-6D, a diffusing of the airflow within the turn passage 650 can be achieved, thus changing the aspect ratio from the inlet 658 toward the outlet 660.

As shown in FIGS. 6A and 6D, the first sidewall 662 is schematically illustrated to show a diffusing angle $\alpha$. The diffusing angle $\alpha$ that represents, as shown, a widening or separation between the first turning surface 666 and the second turning surface 668 as the surfaces 666, 668 extend from the inlet 658 to the outlet 660. In some embodiments, the diffusing angle $\alpha$ can be 15° or less. Further, in some embodiments, the diffusing angle $\alpha$ can be selected such that an aspect ratio at the inlet 658 is less than 1.0 and an aspect ratio at the outlet 660 is less than four times the aspect ratio at the inlet 658. The diffusing angle $\alpha$ can be selected to enable a smooth and continuous ideal area expansion as the coolant flow transitions from the inlet 658 to the outlet 660.

As shown in FIGS. 6A-6B, the first sidewall 662 is curved and extends from the inlet 658 to the outlet 660. The curvature of the first sidewall 662 is selected and arranged such that an edge or end of the outlet 660 does not extend to a position beyond an inside edge of the inlet 658, as illustrated by separation distance D in FIG. 6B. This arrangement is selected to prevent flow separation along the first sidewall 662 as air flow moves from the inlet 658 to the outlet 660 through the turn passage 650.

Turning now to FIGS. 6C-6D, schematic illustration of the angular surface rotation turning rate or twist of the turn passage 650 is shown. In FIGS. 6C-6D, a centerline 670 and a plurality of unit distance indicators 672 are illustratively shown. Each unit distance indicator 672 is separated or spaced a path length L which is constant along the centerline 670 such that the unit distance indicators 672 separate the centerline 670 into equal length sections. The angular surface rotation turning rate or twist of the turn passage 650 is achieved by a twist angle $\beta$. The angular surface rotation turning rate or twist angle $\beta$ is an angle of rotation or twist about the centerline 670 between two adjacent unit distance indicators 672, and may be different for each set of adjacent unit distance indicators 672. The angular surface rotation turning rate or twist angle $\beta$ can be controlled or limited such that the angular surface rotation turning rate or twist angle $\beta$ between any two adjacent unit distance indicators 672 does not exceed 25° per unit distance (as provided by the unit distance indicators 672). In some embodiments, the unit distance indicators 672 are separated by a unit distance of 0.100 inches along the centerline 670. Thus, in this example, a maximum of 25° twist per path length is achieved, which can be selected to prevent flow separation as air flow moves from the inlet 658 to the outlet 660.

Figure 7:
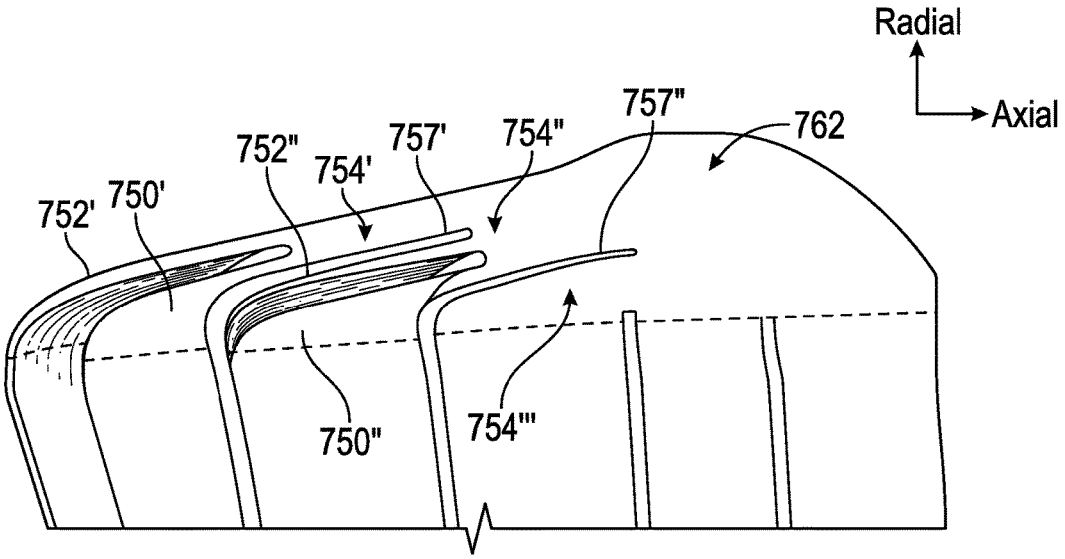
FIG. 7 is a schematic illustration of airflow passages within a turn cap and airfoil in accordance with an embodiment of the present disclosure.

Turning now to FIG. 7, a schematic illustration of airflow passages within an airfoil and turn cap in accordance with an embodiment of the present disclosure is shown. In FIG. 7, the turn cap provides merging passages 754', 754", 754'", similar to that shown and described above. The merging passages 754', 754", 754'" can be fed by airfoil up-pass cavities as described herein, and in some portion fed by turn passages as described herein. As shown a first merging passage 754' is fed by respective first turn passages 750', 752', similar to that shown and described above. A second merging passage 754" is fed by respective second turn passages 750", 752". A third merging passage 754'" is not fed by turn passages but rather is fed directly from airfoil up-pass cavities. The merging passages 754', 754", 754'" collectively supply merged air flow into a merging chamber 762.

As shown in FIG. 7, the first merging passage 754' is separated from second turn passages 750", 752" by a first divider 757'. As air exits the first turn passages 750', 752', the air is merged within the first merging passage 754' and runs along the first divider 757'. The second merging passage 754" is then fed by the first merging passage 754' and airflow from the second turn passages 750", 752". A second divider 757" separates the second merging passage 754' from the third merging passage 754'". As shown, the first and second dividers 757', 757" have different ending points.

The ribs that divide or separate the turn passages of each turning feature (e.g., rib 456" shown in FIG. 4B) are arranged to stop when the flow within the respective turn passages of the turning feature are turned and running parallel to each other, and thus can merge with minimal to no losses. Further, as shown, the first divider 757' is arranged to stop at a position that is aligned with the stop or end of the rib between the second turn passages 750", 752". Thus, the second merging passage 754" includes a merging of the air flow from the second turn passages 750", 752" and the first merging passage 754'. The second divider 757" that separates the second merging passage 754" and the third merging passage 754'" extends toward the merging chamber 762 to a position different from the first divider 757'. That is, the dividers 757 that separate the turning features from each other end as soon as the next turning feature is turned, and thus staggered merging of flows is achieved. As shown in FIG. 7, the extent of the dividers 757 in the axial direction is different between the first divider 757' and the second divider 757". Because of the different axial extents of the dividers 757', 757", a radial height of the turn cap can be reduced or minimized.

Figure 8:
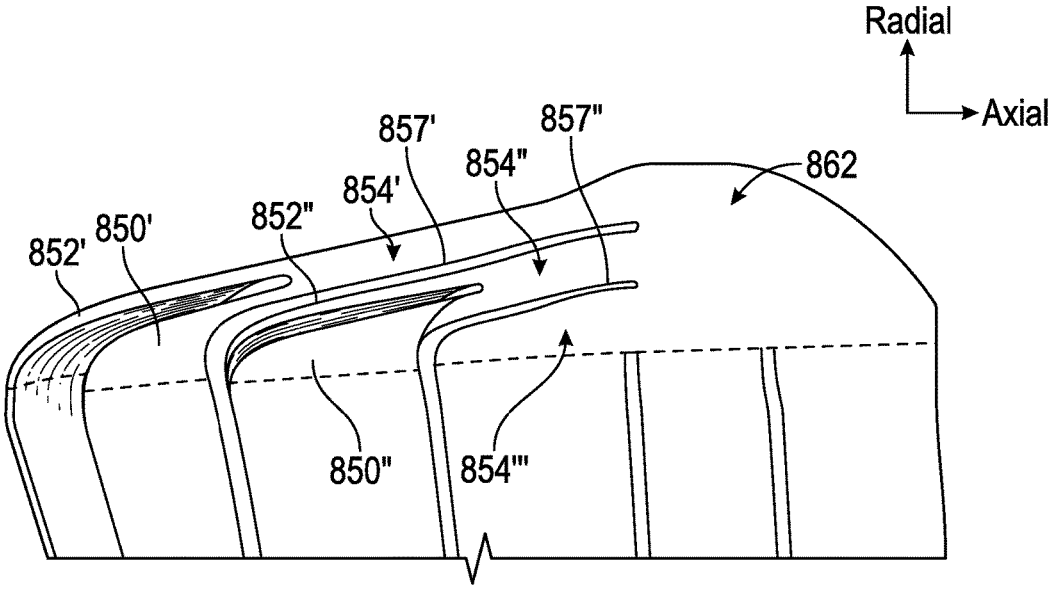
FIG. 8 is a schematic illustration of airflow passages within a turn cap and airfoil in accordance with another embodiment of the present disclosure.

Turning now to FIG. 8, a schematic illustration of airflow passages within an airfoil and turn cap in accordance with another embodiment of the present disclosure is shown. In FIG. 8, the turn cap provides merging passages 854', 854", 854'", similar to that shown and described above. The merging passages 854', 854", 854'" can be fed by airfoil up-pass cavities as described herein, and in some portion fed by turn passages as described herein. As shown a first merging passage 854' is fed by respective first turn passages 850', 852', similar to that shown and described above. A second merging passage 854" is fed by respective second turn passages 850", 852". A third merging passage 854'" is not fed by turn passages but rather is fed directly from airfoil up-pass cavities. The merging passages 854', 854", 854'" collectively supply merged air flow into a merging chamber 862.

As shown in FIG. 8, the first merging passage 854' is separated from second turn passages 850", 852" by a first divider 857'. As air exits the first turn passages 850', 852', the air is merged within the first merging passage 854' and runs along the first divider 857'. In this embodiment, as shown, the first merging passage 854' extends to the merging chamber 862. The second merging passage 854" is fed by the second turn passages 850", 852", with the air flow then entering the merging chamber 862. A second divider 857" separates the second merging passage 854' from the third merging passage 854'". As shown, the first and second dividers 857', 857" have similar ending points.

The ribs that divide or separate the turn passages of each turning feature (e.g., rib 456" shown in FIG. 4B) are arranged to stop when the flow within the respective turn passages of the turning feature are turned and running parallel to each other, and thus can merge with minimal to no losses. In contrast to the embodiment of FIG. 7, the first divider 857' is arranged to stop at a position that is aligned with the stop or end of the second divider 857". That is, the dividers 857 that separate the turning features from each other end at similar axial locations, and thus a merging of flows from all merging passages 854 is achieved. As shown in FIG. 8, the extent of the dividers 857 in the axial direction is the same for the first divider 857' and the second divider 857".

Figure 9:
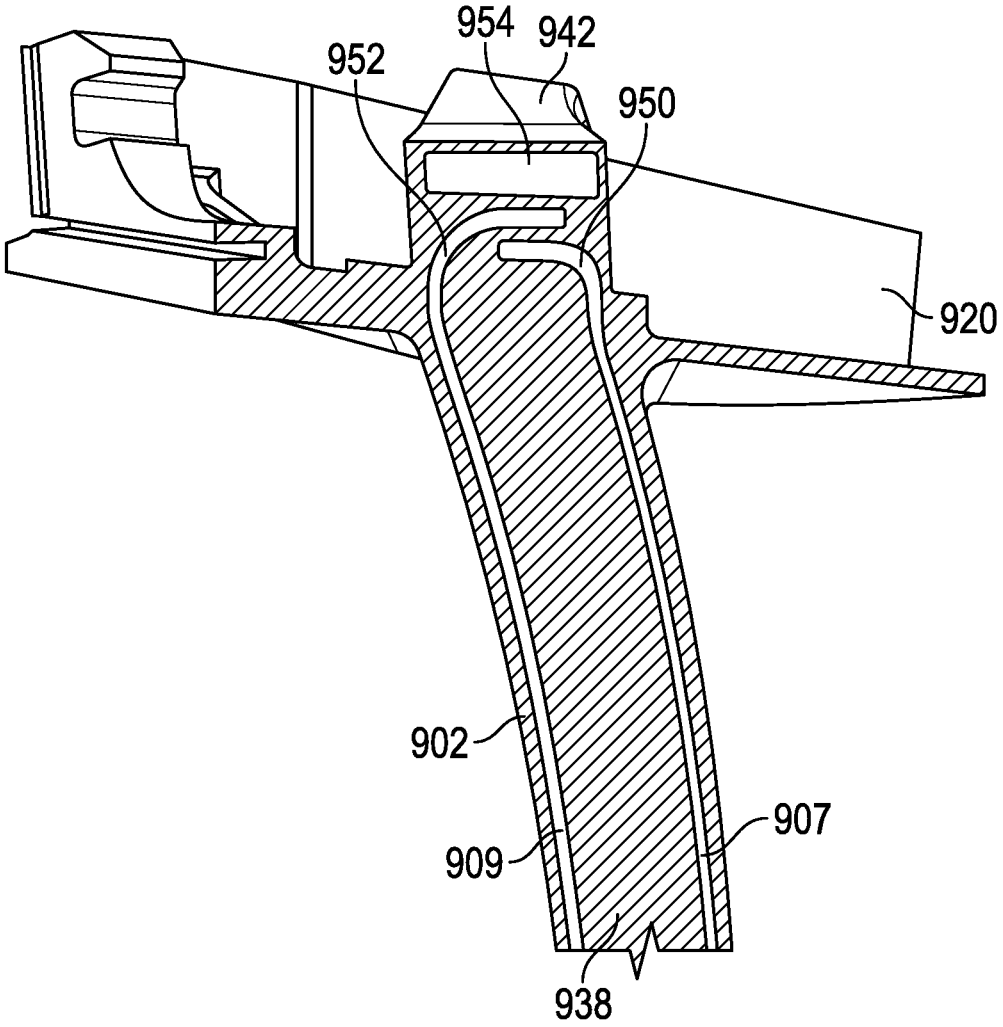
FIG. 9 is a schematic illustration of an integrally formed turn cap and airfoil in accordance with an embodiment of the present disclosure.

Turning now to FIG. 9, a schematic illustration of an integrally cast formed configuration is shown. The integrally cast configuration includes a structure that is formed during a casting process that forms an airfoil 902, a platform 920, and a turn cap 942. The airfoil 902 includes a baffle 938 integrally formed therein, with the baffle 938 held within the airfoil 902 by stand-off elements, as will be appreciated by those of skill in the art. As schematically shown, the airfoil 902 and the turn cap 942 include airflow passages as described herein. For example, as shown in the embodiment of FIG. 9, the airfoil includes a pressure side airfoil passage 907 that is separated from a suction side airfoil passage 909 by the baffle 938. The airfoil passages 907, 909 are fluidly connected to turn cap passages. As shown, a pressure side airfoil passage 907 is fluidly connected to a pressure-side turn passage 950 and a suction side airfoil passage 909 is fluidly connected to a suction-side turn passage 952. The pressure-side turn passage 950 and the suction-side turn passage 952 forms a turning feature within the turn cap 942. The turn cap 942 also includes a merging passage 954 that is fluidly separated from the pressure-side turn passage 950 and the suction-side turn passage 952 and is fed from a different turning feature within the turn cap 942.

As noted, the configuration shown in FIG. 9 is integrally formed using a casting process. The casting process can be one that is typically used for forming airfoils and features thereof, as will be appreciated by those of skill in the art. In another embodiment, the integral configuration shown in FIG. 9 can be manufactured using additive manufacturing processes.

Figure 10:
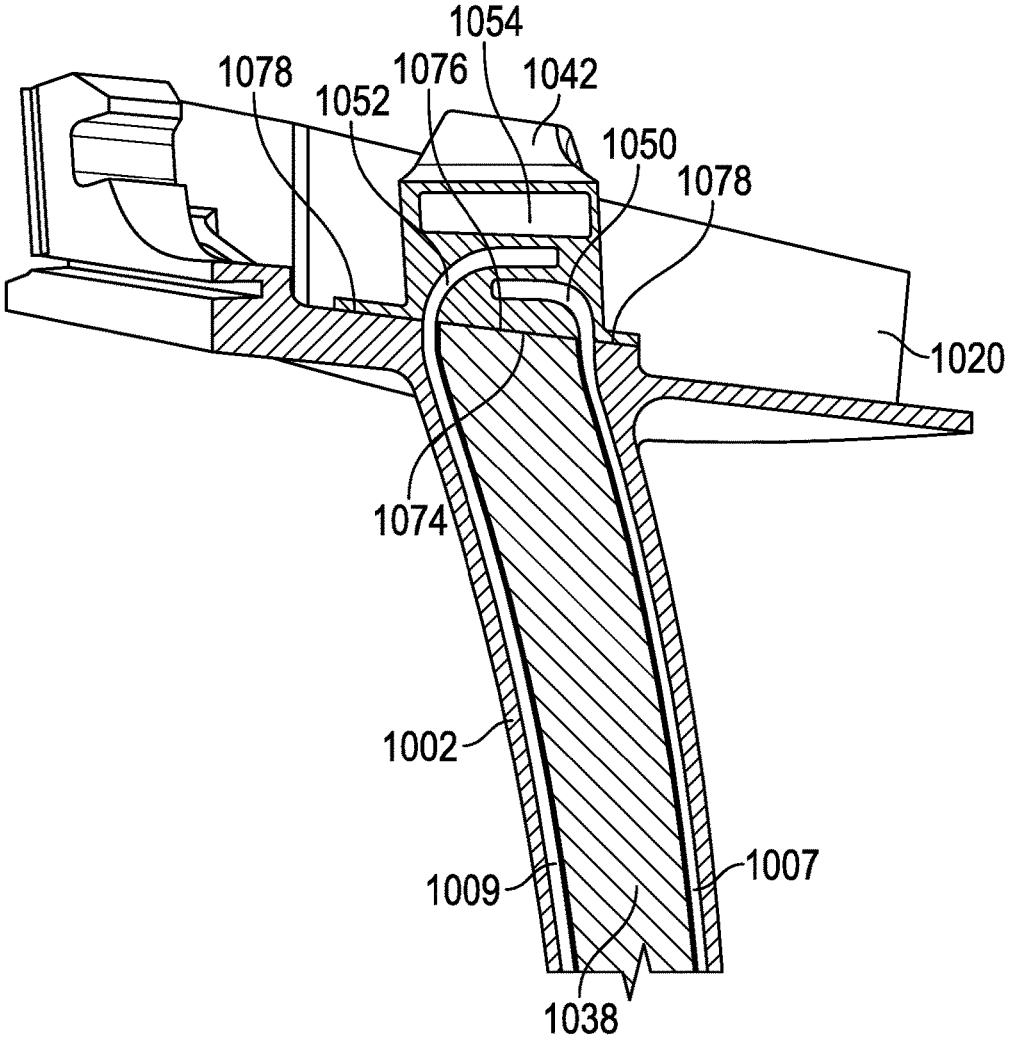
FIG. 10 is a schematic illustration of a turn cap and airfoil that are separately formed and then combined in accordance with an embodiment of the present disclosure.

Turning now to FIG. 10, a schematic illustration of a configuration having separately formed and joined features is shown. The configuration includes structures that are formed during one or more casting or other manufacturing processes and then assembled to form a complete component. The separately formed structures can include an airfoil 1002, a platform 1020, and a turn cap 1042 that are joined and then installed within a gas turbine engine. In the presently shown arrangement the airfoil 1002 and the platform 1020 are integrally formed, and the turn cap 1042 is a separate component attached thereto. The airfoil 1002 includes a baffle 1038 that can be integrally formed therein or separately formed and installed in a traditional manner. The baffle 1038 can be held within the airfoil 1002 by stand-off elements, as will be appreciated by those of skill in the art. In one assembly process, the baffle 1038 is installed within an airfoil cavity of the airfoil 1002 and then the turn cap 1042 is welded, brazed, or otherwise attached to the platform 1020.

As schematically shown, the airfoil 1002 and the turn cap 1042 include airflow passages as described herein. For example, as shown in the embodiment of FIG. 10, the airfoil includes a pressure side airfoil passage 1007 that is separated from a suction side airfoil passage 1009 by the baffle 1038. The airfoil passages 1007, 1009 are fluidly connected to passages within the turn cap 1042 when the turn cap 1042 is attached to the platform 1020 of the airfoil 1002. As shown, a pressure side airfoil passage 1007 is fluidly connected to a pressure-side turn passage 1050 of the turn cap 1042 and a suction side airfoil passage 1009 is fluidly connected to a suction-side turn passage 1052 of the turn cap 1042. The pressure-side turn passage 1050 and the suction-side turn passage 1052 form a turning feature within the turn cap 1042. The turn cap 1042 also includes a merging passage 1054 that is fluidly separated from the pressure-side turn passage 1050 and the suction-side turn passage 1052 and is fed from a different turning feature within the turn cap 1042, as shown and described above.

As noted, the configuration shown in FIG. 10 is formed from multiple separate components. The various components can be formed using casting processes, additive manufacturing, etc. The separate components can then be joined or attached as known in the art. As schematically shown in FIG. 10, the baffle 1038 has a baffle surface 1074 that is complimentary with a cap surface 1076 of the turn cap 1042 which may be joined together using welding, brazing, etc. In some embodiments, the cap surface 1076 is configured to hold or retain the baffle 1038 within the airfoil 1002, even if the baffle 1038 is not attached to the turn cap 1042. That is, the cap surface 1076 can be arranged to stop the baffle 1038 from radial movement when the baffle surface 1074 contacts the cap surface 1076. In some embodiments, the baffle 1038 can be integrally formed with the turn cap 1042 and installed into the airfoil 1002 as a single unit. The platform 1020 includes platform surfaces 1078 to which the turn cap 1042 can be fixedly connected or attached (e.g., welded, brazed, etc.). Advantageously, a separately formed turn cap can enable modification during development without having to change a casting process of the airfoil, platform, and/or baffle.

Figure 11A:
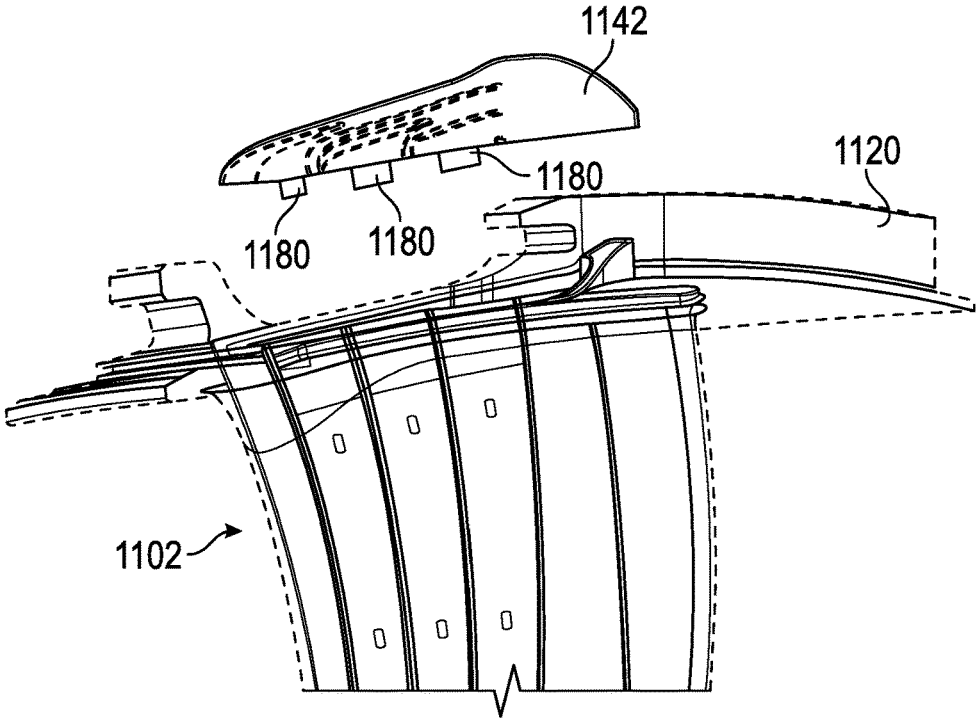
FIG. 11A is a schematic illustration of a turn cap having alignment tabs to enable installation of the turn cap to an airfoil in accordance with an embodiment of the present disclosure.
Figure 11B:
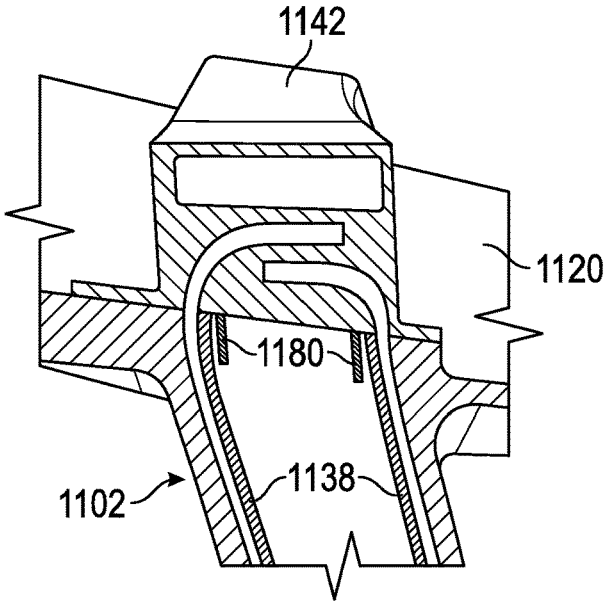
FIG. 11B is a schematic illustration of the turn cap and airfoil of FIG. 11A joined together.

Turning now to FIGS. 11A-11B, schematic illustrations of an installation process of a turn cap 1142 on to a platform 1120 of an airfoil 1102 are shown. In the embodiment of FIGS. 11A-11B, the turn cap 1142 includes one or more alignment tabs 1180 for aiding in positioning the turn cap 1142 relative to the airfoil 1102 and the airfoil cavities therein. In such an embodiment, a baffle 1138 may be hollow such that the alignment tabs 1180 can fit within the baffle 1138. In other embodiments, the baffles can include slots to receive the alignment tabs 1180. For positioning purposes only a single alignment tab 1180 may be needed, however, as shown, the turn cap 1142 can include multiple alignment tabs 1180. In other embodiments, the baffle, the platform, and/or the airfoil can include alignment tabs and the turn cap can include one or more slots to receive the alignment tabs.

In view of the above, as provided herein, turn caps (or portions thereof) are formed as separate piece(s) and joined to the airfoil platform casting or may be integrally formed therewith. In some configurations, optional "space-eater" baffles can be inserted into airfoil cavities before attaching the turn cap or may be integrally formed with the airfoil or the turn cap. The turn caps, as provided herein, may be cast, additively manufactured, formed from sheet metal, or manufactured by other means.

Although various embodiments have been shown and described herein regarding turn caps for airfoils, those of skill in the art will appreciate that various combinations of the above embodiments, and/or variations thereon, may be made without departing from the scope of the invention. For example, a single airfoil may be configured with more than one turn cap with each turn cap connecting two or more adjacent airfoil cavities.

Advantageously, embodiments described herein provide turn caps that may be fixedly attached to (or integrally formed with) non-gas path surfaces of airfoil platforms to fluidly connect airfoil cavities of the airfoil and aid in turning airflow passing therethrough. Such turn caps can be used with serpentine flow paths within airfoils such that at least one up pass and at least one down pass of the serpentine cavity can be fluidly connected in external cavities outside of the core flow path of the gas turbine engine. The turn caps are designed to include an angular surface rotation turning rate that form twisted or curved turning passages that smoothly transition the internal coolant flow that each turn passage receives from each of the respective predominantly radial flow airfoil cavities. The air is turned within the turn passages and aligned such that efficient flow merging can be achieved.

Further, advantageously, such turn caps allow for installation of "space-eater" baffles into curved airfoils, such as bowed vanes, without interference with manufacturing requirements. Furthermore, advantageously, turn caps as provided herein can operate as stop structures to constrain and/or prevent radial, axial, and/or circumferential movement of the "space eater" baffles relative to the cooling channels and adjacent airfoil external sidewalls and ribs in which they are inserted to ensure optimal convective cooling, pressure loss, and thermal performance is maintained.

Moreover, advantageously, embodiments provided herein keep cooling flow streams in each passage separated until all of the flow streams have turned axial and are aligned in the same direction, eliminating pressure losses associated with turbulence caused by the merging of flow streams in different directions. In addition, advantageously, a means of transitioning the cooling passages from an axial aspect ratio to a circumferential aspect ratio in order to fit all of the passages within the limited radial height available is provided.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the spirit and scope of the present disclosure. Additionally, while various embodiments of the present disclosure have been described, it is to be understood that aspects of the present disclosure may include only some of the described embodiments.

For example, although shown with bowed vanes, those of skill in the art will appreciate that airfoils manufactured in accordance with the present disclosure are not so limited. That is, any airfoil where it is desired to have a turn path formed exterior to an airfoil body can employ embodiments described herein.

Furthermore, although shown and described with a single merging chamber, in some embodiment multiple merging chambers can be provided within a turn cap, and each merge chamber can be fluidly isolated from other merging chambers. For example, with reference to FIG. 5, the divider between the merging passages can extend to the right (downstream, toward the trailing edge) and then join with a divider within the airfoil between down-pass cavities **504*b*', 504*b*". In such configuration, the upper merging chamber can be fed by the airflow passing through first and second merging passages 554', 554". As such, air from the radially outward flowing first and second up-pass cavities 504*a*', 504*a*" will be turned and merged within the merging chamber and then directed into the radially inward flowing second down-pass cavity 504*b*". The airflow from the third up-pass cavity 504*a*'" is maintained separate from the merged flows and is turned to supply air into the first down-pass cavity 504*b*'**. Those of skill in the art will appreciate that other various configurations and/or arrangements may be employed without departing from the scope of the present disclosure.

Accordingly, the present disclosure is not to be seen as limited by the foregoing description, but is only limited by the scope of the appended claims.

What is claimed is:

1. An airfoil of a gas turbine engine comprising:

a hollow body defining a first up-pass cavity and a first down-pass cavity, the hollow body having an inner diameter end and an outer diameter end, the first up-pass cavity having a respective first pressure side airfoil passage and a respective first suction side airfoil passage;

a first airfoil platform at one of the inner diameter end and the outer diameter end of the hollow body, the first airfoil platform having a gas path surface and a non-gas path surface, wherein the hollow body extends from the gas path surface;

a first up-pass cavity opening formed in the non-gas path surface of the first airfoil platform fluidly connected to the first up-pass cavity;

a first down-pass cavity opening formed in the non-gas path surface of the first airfoil platform fluidly connected to the first down-pass cavity; and a first turn cap fixedly attached to the first airfoil platform on the non-gas path surface covering the first up-pass cavity opening and the first down-pass cavity opening of the first airfoil platform, the first turn cap having:

a merging chamber fluidly connected to the first down-pass cavity when the turn cap is attached to the first airfoil platform;

a first pressure-side turn passage fluidly connecting the first pressure side airfoil passage to the merging chamber when the turn cap is attached to the first airfoil platform; and a first suction-side turn passage fluidly connecting the first suction side airfoil passage to the merging chamber when the turn cap is attached to the first airfoil platform, wherein each of the first suction-side turn passage and the first pressure-side turn passage turn a direction of fluid flow from a first direction to a second direction such that a fluid flow exiting the first suction-side turn passage and the first pressure-side turn passage are aligned when entering the merging chamber.

2. The airfoil of claim 1, wherein the hollow body, the first airfoil platform, and the first turn cap are integrally formed.

3. The airfoil of claim 1, wherein the first suction-side turn passage and the first pressure-side turn passage form a first turning feature within the turn cap, the turn cap further comprising a second turning feature.

4. The airfoil of claim 3, the turn cap further comprising a first divider fluidly separating the first turning feature from the second turning feature.

5. The airfoil of claim 1, the turn cap further comprising a first merging passage fluidly located between (i) outlets of the first suction-side turn passage and the first pressure-side turn passage and (ii) the merging chamber.

6. The airfoil of claim 1, wherein at least one of the first pressure-side turn passage and the first suction-side turn passage has:

an inlet that fluidly connects to the first up-pass cavity when the turn cap is attached to the first airfoil platform;

an outlet that fluidly connects to the merging chamber;

a first sidewall;

a second sidewall;

a first turning surface; and a second turning surface, wherein each of the first sidewall, the second sidewall, the first turning surface, and the second turning surface extend from the inlet to the outlet.

7. The airfoil of claim 6, wherein the inlet has a first aspect ratio that matches an aspect ratio of the first up-pass cavity and the outlet has a second aspect ratio.

8. The airfoil of claim 7, wherein the first aspect ratio and the second aspect ratio are different.

9. The airfoil of claim 8, wherein the second aspect ratio is less than four times the first aspect ratio.

10. The airfoil of claim 1, wherein at least one of the first pressure-side turn passage and the first suction-side turn passage has an angular surface rotation turning rate or twist defined with a maximum twist angle per unit distance along a centerline of the respective passage.

11. The airfoil of claim 10, wherein the maximum angular surface rotation turning rate or twist angle is 25° and the unit distance is 0.100 inches.

12. The airfoil of claim 1, further comprising a "space-eater" baffle positioned in at least one of the up-pass cavities.

13. The airfoil of claim 1, further comprising:

a second up-pass cavity within the hollow body having a respective second pressure side airfoil passage and a respective second suction side airfoil passage;

a second up-pass cavity opening formed in the non-gas path surface of the first airfoil platform fluidly connected to the second up-pass cavity; and the first turn cap covering the second up-pass cavity opening, the first turn cap comprising:

a second pressure-side turn passage fluidly connecting the second pressure side airfoil passage to the merging chamber when the turn cap is attached to the first airfoil platform; and a second suction-side turn passage fluidly connecting the second suction side airfoil passage to the merging chamber when the turn cap is attached to the first airfoil platform, wherein each of the second suction-side turn passage and the second pressure-side turn passage turn a direction of fluid flow from a first direction to a second direction such that a fluid flow exiting the second suction-side turn passage and the second pressure-side turn passage are aligned when entering the merging chamber.

14. A turn cap for an airfoil of a gas turbine engine, the turn cap comprising:

a first pressure-side turn passage extending from a respective inlet to a respective outlet within the turn cap;

a first suction-side turn passage extending from a respective inlet to a respective outlet within the turn cap; and a merging chamber fluidly connected to the outlets of the first pressure-side turn passage and the first suction-side turn passage, wherein each of the first suction-side turn passage and the first pressure-side turn passage turn a direction of fluid flow from a first direction to a second direction such that a fluid flow exiting the first suction-side turn passage and the first pressure-side turn passage are aligned when entering the merging chamber.

15. The turn cap of claim 14, wherein the first suction-side turn passage and the first pressure-side turn passage form a first turning feature within the turn cap, the turn cap further comprising a second turning feature.

16. The turn cap of claim 15, the turn cap further comprising a first divider fluidly separating the first turning feature from the second turning feature.

17. The turn cap of claim 14, the turn cap further comprising a first merging passage fluidly located between (i) outlets of the first suction-side turn passage and the first pressure-side turn passage and (ii) the merging chamber.

18. The turn cap of claim 14, wherein at least one of the first pressure-side turn passage and the first suction-side turn passage has:

a first sidewall extending from the inlet to the outlet;

a second sidewall extending from the inlet to the outlet;

a first turning surface extending from the inlet to the outlet; and a second turning surface extending from the inlet to the outlet, wherein the inlet is oriented in a first direction and the outlet is oriented in a second direction different from the first direction.

19. The turn cap of claim 18, wherein the inlet has a first aspect ratio and the outlet has a second aspect ratio that is different from the first aspect ratio.

20. The turn cap of claim 14, wherein at least one of the first pressure-side turn passage and the first suction-side turn passage has an angular surface rotation turning rate or twist defined with a maximum twist angle per unit distance along a centerline of the respective passage.

* * * * *